US008919493B2

(12) United States Patent
Halliday

(10) Patent No.: US 8,919,493 B2
(45) **Date of Patent: *Dec. 30, 2014**

(54) METHOD AND APPARATUS FOR ALTERING AND OR MINIMIZING UNDERWATER NOISE

(71) Applicant: Christopher I. Halliday, Phoenixville, PA (US)

(72) Inventor: Christopher I. Halliday, Phoenixville, PA (US)

(73) Assignee: Pulmonari, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/963,591

(22) Filed: Aug. 9, 2013

(65) Prior Publication Data

US 2014/0026886 A1 Jan. 30, 2014

Related U.S. Application Data

(63) Continuation of application No. 13/082,821, filed on Apr. 8, 2011, now Pat. No. 8,505,681, which is a continuation of application No. 12/215,564, filed on Jun. 26, 2008, now Pat. No. 7,921,964.

(60) Provisional application No. 60/937,161, filed on Jun. 26, 2007, provisional application No. 60/967,631, filed on Sep. 6, 2007, provisional application No. 61/007,793, filed on Dec. 13, 2007.

(51) Int. Cl.

| | |
|---|---|
| ***B63C 11/12*** | (2006.01) |
| ***B63C 11/02*** | (2006.01) |
| ***B63C 11/22*** | (2006.01) |

(52) U.S. Cl.

CPC ..... *B63C 11/02* (2013.01); *B63C 11/2227* (2013.01)

USPC ..... 181/235; 128/200.27; 128/200.29

(58) Field of Classification Search

CPC ..... B63C 11/2227; B63C 11/02

USPC ..... 181/18, 235; 128/200.27, 200.28, 128/200.29, 201.27

See application file for complete search history.

(56) References Cited

U.S. PATENT DOCUMENTS

| | | | | |
|---|---|---|---|---|
| 3,415,245 | A * | 12/1968 | Yamamoto et al. | 128/201.19 |
| 4,284,169 | A * | 8/1981 | Tulloch | 181/211 |
| 4,467,797 | A * | 8/1984 | Franke | 128/204.26 |
| 4,527,657 | A * | 7/1985 | Payne | 181/18 |
| 4,527,658 | A * | 7/1985 | Payne | 181/235 |
| 4,852,682 | A * | 8/1989 | Benjamin | 181/121 |
| 5,079,775 | A * | 1/1992 | Kaburaki | 128/200.29 |
| 5,159,923 | A * | 11/1992 | Kaburaki | 128/201.27 |
| 5,209,226 | A * | 5/1993 | Goodley | 128/205.25 |
| 5,375,100 | A * | 12/1994 | Snape | 367/143 |
| 5,825,718 | A * | 10/1998 | Ueki et al. | 367/132 |
| 6,644,307 | B2 * | 11/2003 | Morgan et al. | 128/200.29 |
| 6,817,359 | B2 * | 11/2004 | Deas et al. | 128/201.27 |
| 7,921,964 | B2 * | 4/2011 | Halliday | 181/235 |
| 8,505,681 | B2 * | 8/2013 | Halliday | 181/235 |
| 2006/0272637 | A1 * | 12/2006 | Johnson | 128/201.27 |

FOREIGN PATENT DOCUMENTS

| | | | | |
|---|---|---|---|---|
| JP | 07309292 A | * | 11/1995 | B63C 11/22 |

* cited by examiner

*Primary Examiner* — Jeremy Luks

(57) ABSTRACT

To reduce or eliminate the startle response in aquatic life, embodiments of the present invention alter the sound produced by a diver's exhaled bubbles by adjusting up or down the frequency of the sound produced by the bubbles.

15 Claims, 15 Drawing Sheets

(a)

(b)

METHOD AND APPARATUS FOR ALTERING AND OR MINIMIZING UNDERWATER NOISE

CROSS REFERENCE TO RELATED APPLICATIONS

The present application is a continuation of application Ser. No. 13/082,821, filed on Apr. 8, 2011, which is a continuation of application Ser. No. 12/215,564, now U.S. Pat. No. 7,921,964, filed on Jun. 26, 2008, which in turn claims priority to provisional application No. 61/007,793 filed on Dec. 13, 2007, provisional application No. 60/967,631 filed on Sep. 6, 2007 and provisional application No. 60/937,161, filed on Jun. 26, 2007, the contents of each of which are hereby incorporated by reference.

BACKGROUND

This invention relates broadly to SCUBA (self contained under water breathing apparatus).

A major problem facing recreational divers and the like is the startle response of fish caused by a diver's exhalation through an open circuit breathing system. The bubbles from the diver's exhalation normally pass the face, and generate substantial noise as they grow and coalesce. The problem has been previously addressed by divers through potentially harmful breath holding and conversion to closed circuit breathing systems.

Accordingly, the present invention addresses the fish startle response problem and provides inexpensive solutions to the fish startle response problem to the benefit of recreational divers, underwater photographers and the like, particularly in open circuit breathing systems.

BRIEF SUMMARY OF THE INVENTION

In one embodiment, a composition includes a frequency adjustor that alters at least a portion of the frequency of sound produced by exhaled gas from a diving regulator, wherein the frequency of sound produced by the bubbles exiting the frequency adjustor into surrounding fluid have a frequency that approximates the background noise of the fluid into which the bubbles are introduced.

In another embodiment, a composition includes a second stage scuba regulator and a frequency adjustor wherein the frequency adjustor has an average porosity between 100 and 500 microns and a void volume of greater than 20%, and wherein less than 80% of the void volume of the frequency adjustor is filled with water in 1 to 3 seconds during a diver inhalation; wherein the frequency adjustor is in fluid communication with the second stage scuba regulator such that at least a portion of exhaled gas is urged to exit the second stage regulator and enter the frequency adjustor; wherein at least 50% of the volume of gas exhaled by the diver exits the frequency adjustor and enters the water over the time of a diver exhalation; and wherein the frequency adjustor alters the frequency of sound produced by exhaled gas by increasing the amount of sound produced by the bubbles to above 105 Hz and by reducing the amount of sound produced by the bubbles between 10 and 100 Hz.

In yet another embodiment, a method of quieting the noise made by a diver includes the steps of:

a. directing exhaled gas from a diving regulator into a frequency adjustor, wherein the gas passes through the frequency adjustor and escapes into the surrounding fluid;

b. reducing the bubble size of the bubbles exiting the frequency adjustor into surrounding fluid relative to the size of the bubbles in the absence of the frequency adjustor; and c. increasing the frequency of sound produced by the bubbles exiting the frequency adjustor into surrounding fluid to a frequency that approximates the background noise of the fluid into which the bubbles are introduced.

DETAILED DESCRIPTION OF THE INVENTION

As used throughout, ranges are used as a shorthand for describing each and every value that is within the range. Any value within the range can be selected as the terminus of the range. For the sake of brevity, unless otherwise specified, each value in a list of values can be used singly in an embodiment of the invention. For example as used herein, the format of the list of percentages "20%, 25%, 30%, 40%, 50%, 55%, 60%, 65%, 70%, 75%, 80%, 85%, 90%, or 95%" would be understood to mean "In one embodiment, 20% . . . . In another embodiment 25% . . . . In yet another embodiment, 30% . . . . In yet another embodiment, 40% . . . " etc.

The following description relates to A) Conduction of Sound, B) Startle Response of Fish, C) Altering Noise Generated by A Diver by: (1) Changing the Frequency of Sound Produced by a Diver's Bubbles; and (2) Attenuating Sounds Produced by a Diver Through Active Noise Cancellation.

A. Conduction of Sound in Water

Figure 1:
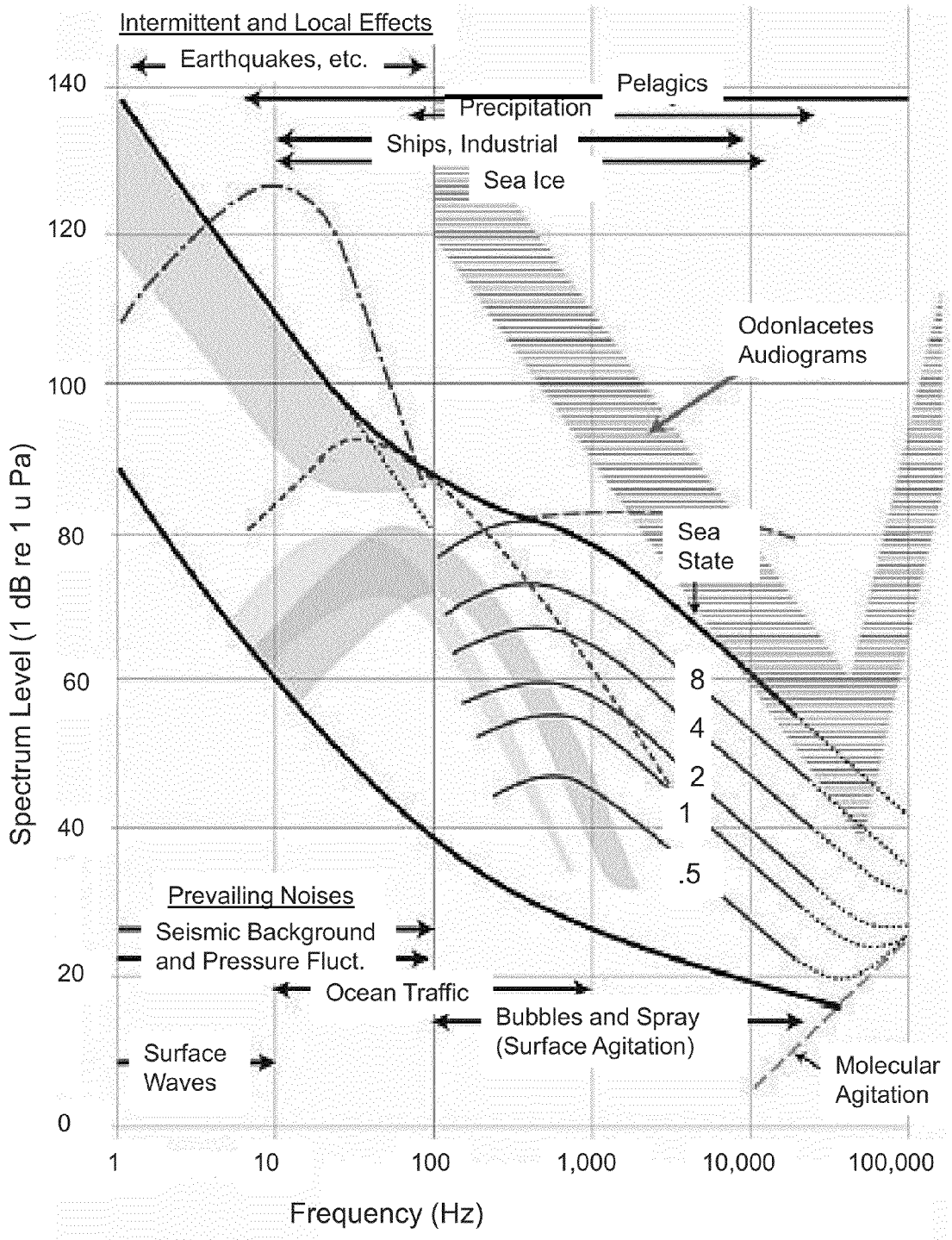
FIG. 1 represents a graphical representation of noises commonly found in the ocean.

The background sounds typically present in the ocean can be summarized in FIG. 1 which shows typical sound levels at different frequencies present in the ocean. The sound levels in FIG. 1 are in dB relative to 1 μPa in a 1 Hz wide frequency band, which is usually written "dB re 1 $\mu Pa^2/Hz$." The speed of sound in water exceeds that in air by a factor of 4.4 and the density ratio is about 820. For purposes of the present invention, background noise, particularly with respect to ocean background noise, is understood to mean noise having a frequency greater than 100 Hz and less than 100,000 Hz.

A sound wave propagating underwater, in fresh or salt water, includes alternating compressions and rarefactions of the water. These compressions and rarefactions are detected by a receiver (e.g. a hydrophone), as well as animals such as a fish and humans as changes in pressure.

As noted above, sound in water can be measured using a hydrophone, which is the underwater equivalent of a microphone. A hydrophone measures pressure fluctuations, and these are usually converted to sound pressure level (SPL), which is a logarithmic measure of the mean square acoustic pressure. As with airborne sound, SPL is usually reported in units of decibels, but there are some important differences that make it difficult (and often inappropriate) to compare SPL in water with SPL in air. These differences include:

- difference in reference pressure: 1 μPa (one micropascal, or one millionth of a pascal) instead of 20 μPa.
- difference in interpretation: there are two schools of thought, one maintaining that pressures should be compared directly, and that the other that one should first convert to the intensity of an equivalent plane wave;
- difference in hearing sensitivity: any comparison with (A-weighted) sound in air needs to take into account the differences in hearing sensitivity, either of a human diver or other animal.

Measurements are usually reported in one of three forms:

- RMS acoustic pressure in micropascals (or dB re 1 μPa)
- RMS acoustic pressure in a specified bandwidth, usually octaves or thirds of octave (dB re 1 μPa)
- spectral density (mean square pressure per unit bandwidth) in micropascals per hertz (dB re 1 $\mu Pa^2/Hz$)

The background noise present in the ocean, or ambient noise, has many different sources and varies with location and frequency. At the lowest frequencies, from about 0.1 Hz to 10 Hz, ocean turbulence and microseisms are the primary contributors to the noise background. Typical noise spectrum levels decrease with increasing frequency from about 140 dB re 1 $\mu Pa^2/Hz$ at 1 Hz to about 30 dB re 1 $\mu Pa^2/Hz$ at 100 kHz.

The lowest audible SPL for a human diver with normal hearing is about 67 dB re 1 μPa, with greatest sensitivity occurring at frequencies around 1 kHz, or about 10 to 100 times higher than the frequencies that produces a startles response in fish, as described below. Dolphins and other toothed whales are renowned for their acute hearing sensitivity, especially in the frequency range 5 to 50 kHz. Several species have hearing thresholds between 30 and 50 dB re 1 μPa in this frequency range. For example the hearing threshold of the killer whale occurs at an RMS acoustic pressure of 0.02 mPa (and frequency 15 kHz), corresponding to an SPL threshold of 26 dB re 1 μPa. By comparison the most sensitive fish is the soldier fish, whose threshold is 0.32 mPa (50 dB re 1 μPa) at 1.3 kHz, whereas the lobster has a hearing threshold of 1.26 Pa at 70 Hz (122 dB re 1 μPa).

B) Startle Response in Fish

Many problems face SCUBA divers when trying to approach underwater animals. Unless acclimated to a diver's presence or trained to approach a diver because the animal has learned to associate a diver or the noise produce by a diver with the presence of food in the water (e.g., Stingray City in Grand Cayman), fish typically keep a significant distance from divers.

One solution is to use the particular visual queues that fish use to recognize and distinguish predators from prey. An example of such a solution is provided by U.S. Pat. No. 7,189,128, the entire contents of which are hereby incorporated by reference. In one embodiment, the '128 patent provides a coloration pattern that is visible to animals and which induces a response in the animals.

However, in addition to visual queues, it has been discovered that infrasound causes a startle response in fish, as explained in "Infrasound initiates directional fast-start escape responses in juvenile roach Rutilis rutilis" The Journal of Experimental Biology 207, 4185-4193, Sep. 6, 2004, the entire contents of which are hereby incorporated by reference.

The otolith organs of the inner ears in fish are inertial motion detectors directly stimulated by the particle accelerations of a sounds wave in water, and in some instances down to at least 0.1 Hz, and fish use these organs to determine the three dimensional directionality of a sound wave in water. Moreover, certain fish which have a swim bladder, may show amplified radial motions that are transmitted to the inner ear, providing auditory gain to the fish. Contrast the preceding with human hearing underwater where it is virtually impossible to tell the direction of origination of a sound.

Importantly, it has been shown that fish are highly sensitive to the acceleration component of infrasound by using their inner ear, and infrasound readily elicits escape and other evasive actions in fish, as explained in the article by Sand et al. "Detection of Infrasound" Am. Fish. Soc. Symp. 26, 183-193 (2001), the entire contents of which are hereby incorporated by reference. Moreover, a typical attack by a predatory fish produces complex hydrodynamic and acoustic stimuli with frequency components mainly below 100 Hz. Without wishing to be bound by theory, it is believed that low frequency sounds that can be produced by a diver in the ordinary course of diving induces a startle response in fish, and in particular nearby fish, because the fish confuse the sounds made by the diver with the sounds of an attacking predatory fish and the startle response is an instinctual response designed to prevent the fish from being eaten.

C) Altering Noise Generated by A Diver

Testing and experience has shown that the exhaled air of diver, as it exits the diver's regulator (such a regulator described in U.S. Patent Publication No. 20050016537, the entire content of which is incorporated by reference) and forms bubbles, the bubbles produce noise across a wide range of frequencies and decibels. Moreover, the frequency of sound is not constant, in that the frequency undergoes rapid changes over time and multiple different frequencies can be present at the same time. With respect to the present invention it is important to note that upon formation and shortly thereafter the bubbles from a conventional second stage regulator produce infrasound in the range of 30 to 100 Hz, the same frequency range (e.g., below 100 Hz) produced by an accelerating predatory fish as explained above in Part B. For purposes of the instant invention, the focus is primarily on the frequency of a sound.

Accordingly, in one embodiment, the present invention includes a component or device that alters the sound produced by a diver's exhaled bubbles by adjusting up or adjusting down at least a portion of the frequency of the sound produced by bubbles. This is accomplished by adjusting the size of the bubbles formed when exhaled gas enters a surrounding fluid. In another embodiment, the velocity of the gas as it enters the fluid is adjusted up or down.

In another embodiment, the present invention includes a component that produces sound at the same frequency as noises produced by a diver (e.g., from bubbles, or inadvertent equipment contact, fin noise, contact with objects in the water, etc), wherein the produced sound is 180 degrees out of phase with the diver produced noise. In yet another embodiment, the present invention includes a component that alters the sound produced by a diver's exhaled bubbles by increasing the frequency of the sound produced by the bubbles and simultaneously produces sound at the same frequency as the altered sound of exhaled bubbles, wherein the produced sound is 180 degrees out of phase with the adjusted bubble noise. Each are discussed in more detail below.

C. (1) Adjusting the Sound Produced by a Diver's Bubbles

In one embodiment, the present invention includes a component which alters or adjusts the frequency of sound produced by a diver, and in particular the sound produced by a diver's exhaled gas as the gas forms bubbles in a surrounding fluid (e.g., water). In another embodiment, the present invention includes one or more components of a system configured to place exhaled gas in fluid communication with a frequency adjustor. In another embodiment, the present invention includes a system of components including a frequency adjustor.

Many references in the art discuss how bubbles and attendant noise interfere with a diver's vision and communication ability. For example, U.S. Pat. Nos. 6,644,307, 4,527,658, 3,474,782, 3,568,672 and 2,485,908, the contents of each of which are hereby incorporated by reference. Of particular interest is the '908 patent which describes how the small apertures of a muffler attached to the top of a diving mask are effective in maintaining the size of the bubbles at a minimum, which in turn produce less noise and vibration. However, this reference is directed to reducing the volume (e.g., dB) of the sound, i.e., muffle the sound, and it, along with the other references cited above, fails to recognize the importance of the frequency component of the noise produced by the bubbles as it relates to the startle response of fish. More importantly, the '908 reference fails to teach the importance of reducing the amount of sounds produced in the 10 to 100 Hz range and/or increasing the frequency of sound produced by the bubbles to a frequency above about 100 Hz or reducing the frequency of sound below 10 Hz. Moreover, these references are typically directed to underwater communication, and by increasing the frequency of the sound produced by the bubbles to greater than 100 Hz or increasing the amount of sound produced at greater than 100 Hz, communication can be interfered with because of the sensitivity of the human ear to sounds above 100 Hz. Additionally, none of the art teaches adjusting the frequency of the sound or SPL produced by the bubbles, much less how to adjust the sound, to approximate the frequency of sound present as background noise in the fluid into which the bubbles are released or to reduce at least a portion of sound in the spectrum of sound that is produced by an accelerating fish.

C(1)(a) Frequency Adjustor

In one embodiment, the present invention includes a frequency adjustor that alters the size of the bubbles produced by exhaled gases as the bubbles enter a fluid. In certain embodiments, this is accomplished by using a porous structure. In certain embodiments, the frequency adjustor is in fluid communication with a second stage scuba regulator. For purposes of "fluid communication" gasses (e.g., exhalation gases) are to be considered fluid.

Structure

Figure 6:
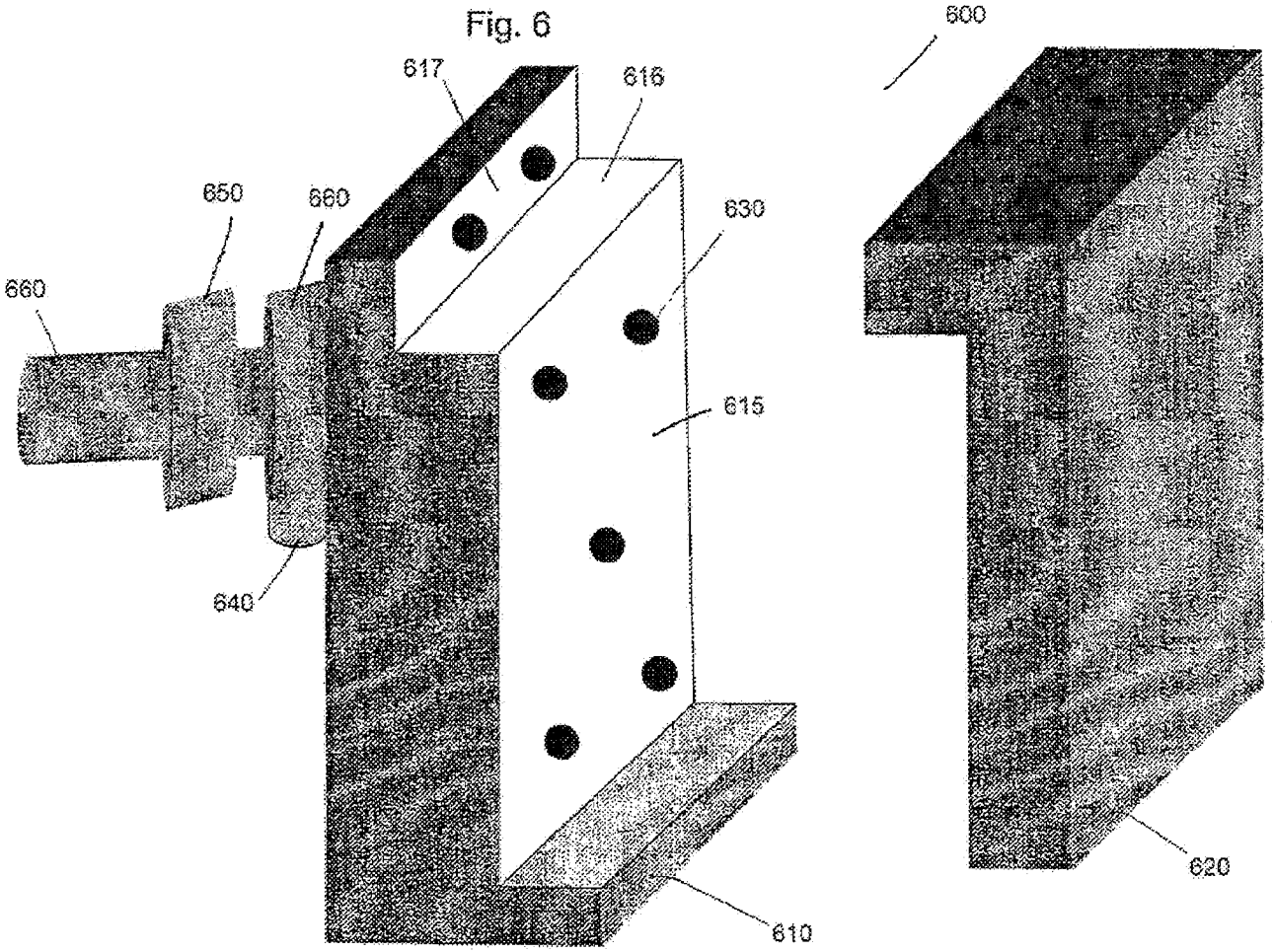
FIG. 6 represents a partially exploded view of a frequency adjustor.

A frequency adjustor of the present invention can be any regular or irregular shape. FIG. 6 provides a partially "exploded view" representation of one embodiment of a frequency adjustor 600 of the invention. Adjustor manifold 610 and material 620 can be joined at one or more of interfaces 615, 616 and 617 or elsewhere. Manifold 610 can include one or more pores 630, which are in communication (e.g., fluid communication) with hollow port 660. Hollow port 660 is used to connect frequency adjustor 600 to a first stage. For example, port 660 can be removably affixed to female port 710 of FIG. 7 by turning screw 650, much like a conventional DIN valve fitting. Check valve 660 prevents fluid (e.g., a gas or liquid) from flowing back through material 620 and manifold 610 and then back into port 660. Additionally, if optional venturi assist exhalation, as detailed further below, is to be used, adjustor 600 can include port 640 for connection to a gas supply via a hose (e.g. a quick connect hose or the like) to a port 730 (shown on FIG. 7) on a first stage. Thus, when check valve 660 is actuated via gas flowing through port 660, a venturi assist activates by allowing gas from a breathing supply to enter the frequency adjustor, thereby "pulling", via the ventui effect, exhaled gas out of the exhaled gas conduit (not shown) through manifold 740 and into frequency adjustor 600 via port 660.

Figure 7:
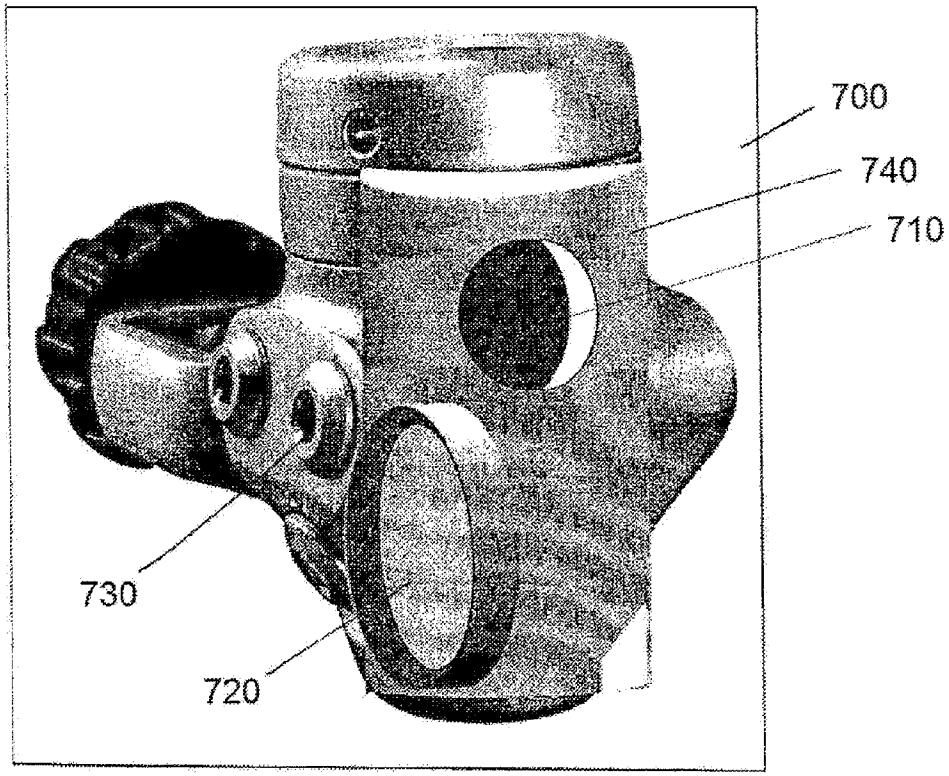
FIG. 7 represents a first stage having a connection manifold for connecting the exhaust gas conduit to a frequency adjustor.

FIG. 7 provides a first stage 700 having a connection manifold 740 for connecting the exhaust gas conduit to a frequency adjustor. Manifold 740 includes opening 710 for receiving port 660. Manifold 740 also includes opening 720 for receiving an exhaled gas conduit (not shown) by a connection, e.g. a quick connect or valve type fitting. Port 730 can be used to supply optional gas to the optional venturi assist component of frequency adjustor 600.

In one embodiment, the frequency adjustor of the present invention also includes a check valve or adjustable check valve/pressure relief valve to prevent undue pressure buildup. During periods of heavy exertion, to prevent difficulty with exhalation a diver can adjust the check valve to release exhaled gas directly to a fluid once a certain threshold pressure has been achieved inside the frequency adjustor, essentially bypassing the frequency adjustor. In certain embodiments, the check valve is manually adjustable "on the fly" to suit the needs of the diver at the particular moment. Rather than open the frequency adjustor directly to the fluid by activating the switch 800 described above, the diver can simply adjust the check valve such that it only activates once an internal pressure is exceeded. Such an embodiment can also assist with ear clearing. In certain embodiments, the adjustable valve can be placed into a frequency adjustor of the present invention by first drilling a hole into the frequency adjustor at an appropriate location or by fixing the adjustable valve in place as part of a frequency adjustor molding process.

In other embodiments, the frequency adjustor is located near the tank, typically behind the diver's head. To enhance reduction of obscuring a diver's vision, it is contemplated, though not required, to secure an exhalation conduit directly to the hose that connects the first stage of the regulator (the regulator connected to the tank) to the second stage (i.e., the actual regulator) to connect the second stage exhalation port with the frequency adjustor.

In retrofit configurations, such securing can be accomplished by adhesives, clamps, sleeves, spiral sleeves, or other attachment methods that are apparent to one of skill in the art upon reading this disclosure. Accordingly, the conduit 60 should also be as flexible, if not more flexible, than the hose which connects the first and second stages (i.e., the hose that provides breathing gas to the diver). Moreover, because the pressure on the exhaled gas is less than the gas in the hose between the first and second stages, and in order to accommodate the volume of gas, in one embodiment, the diameter of the conduit between the regulator and the frequency adjustor and/or underwater transducer is 0.8, 1, 1.2, 1.5, 1.75, 2, 2.5, or 3 times or more the diameter of the conduit (e.g., a gas hose) between the first and second stages that provides gas to the second stage regulator.

In one embodiment, the conduits are concentric. In such an embodiment, the higher pressure gas conduit to the diving regulator is generally centered and surrounded by a conduit which transports low pressure/exhaled gas away from the regulator. In one embodiment, the conduit for transporting exhaled gas includes at least one spiral wall throughout its length, either attached to the outer conduit, inner conduit, or both. It has been found that the spiral wall functions to support the center conduit and imparts some rigidity to the outer conduit thereby reducing incidences of conduit kinking. The spiral wall also induces a spiral effect in the gas as it passes through the conduit from the regulator, surprisingly reducing back pressure by easing gases into the frequency adjustor.

In one embodiment, the conduit further includes one or more check valves or other type of valve that prevents fluid from entering the conduit and/or regulator exhaust port, such as the valve described in U.S. Pat. No. 2,168,695, the contents of which are hereby incorporated by reference or a flap the flutters between an open and closed condition. In one embodiment, the check valve is upstream from the conduit and thereby permits fluid in the conduit but prevents fluid from entering into the regulator exhaust port(s). In one embodiment, the check valve is located as close to or proximate to the frequency adjustor and/or underwater transducer as practicable. In yet another embodiment, a check valve is located downstream from the regulator, in-line with the conduit that connects the regulator to the frequency adjustor and/or underwater transducer, but upstream from the frequency adjustor and/or underwater transducer. In such an embodiment, the amount of fluid in the regulator and conduit is minimized and therefore any inadvertent noise, and in particular bubbles within the regulator or conduit that may produce noise in the 10 to 100 Hz range, is minimized because bubbles formation is reduced therein. Moreover, the amount of fluid that needs to be displaced in order for the exhaled gas to pass through the regulator and conduit in the absence of the check valve is also minimized, thereby reducing backpressure and minimizing diver exhalation effort. In certain embodiments, the exhalation effort can be measured in inches of water. Depending on the choices of design as described herein, the average exhalation effort can be less than or equal to about 1, 1.5, 2, 2.5, 3, 3.5, 4, 4.5, 5, 5.5, 6, 7, 8, 9, 10, 15, or 20 inches of water. In certain embodiments, the exhalation effort can be between 1.5 and 5 inches of water. In certain embodiments, the exhalation effort is between 2.5 and 10 inches of water.

The conduit, check valve(s) and other components should be constructed using materials that are resistant to rust and corrosion, e.g., rubber, plastic and the like.

To further reduce back pressure, the frequency adjustor can optionally further include a vent coupled to the air supply. In such an embodiment, the vent can be actuated by movement of a check valve proximal to the frequency adjustor. By actuating the vent, a venturi effect can be imparted upon the gasses entering the frequency adjustor to assist in urging gas from the exhalation conduit into the frequency adjustor, as described above. Essentially, a portion of the gas supply that would normally be breathed is used to assist in reducing exhalation effort. Given the widespread use of the venturi effect in inhalation technology for second stage regulators, development and design of a venturi effect component for assisting in exhalation, rather than inhalation, is believed to be routine.

To further reduce backpressure, in addition to or in the absence of a venturi effect, as described above, the present invention can include a pump to induce a suction during exhalation, thereby easing exhalation effort and also to urge exhaled gases through the frequency adjustor. The pump can be powered by batteries or in the alternative by the pressure drop caused by gases directed to the diver during inhalation.

For example, U.S. Pat. Nos. 7,218,009, 6,784,559, 4,731,545 and 4,511,806, the contents of each of which are hereby incorporated in their entirety, describe pressure drop power generation.

In certain embodiments, the inlet and the outlet are on the same side of the housing. An electronic control compartment may be positioned adjacent the housing for housing a regulator of known design for limiting the alternating current output of the coil device. Also, magnetic saturation circuits may be included for storing electrical energy in order to compensate for lapses in the output of the coil caused by the periodicity of breathing. In some embodiments, the rotor structure comprises a generally cylindrical rotor member of known design, having alternating bar magnets arranged circumferentially and extending axially thereof, as shown, such that the magnets are in the vicinity of the coil so as to inductively influence the coil. At the other end of the rotor is a circumferentially arranged array of air pocket vane members which cause the rotor to rotate by means of the air pressure emanating from the high pressure source. It has been surprisingly found that the frequency of the bubbles emitted from the frequency adjustor can be further adjusted by increasing or decreasing the force applied to the exhalation gas by adjusting the power supplied to the exhalation gas pump or an exhaust pump. In one embodiment, the exhaust pump is controlled by a feedback loop such that the exhaust pump shuts off when the cylindrical rotor member is activated (e.g., by inhalation or over depressurization of the exhaust line (which in turn may activate the second stage regulator and simulate inhalation). In another form of control, the exhaust pump may engage after a lag time (e.g., 1 to 2 seconds or more) of continued exhalation engage for only a short period, e.g., 5 to 10 seconds and then have a minimum shut off time (e.g., 1 second).

The power derived from the above generator can be used to power the exhaust pump, as well as a light source, e.g., a low wattage LED light source, as well as any computers and/or transducers for use with active noise cancellation, described above.

Materials and Porosity

In one embodiment, at least a portion of the porous material of the invention can be formed by machining, melting, gluing or sintering small particles together, optionally in a mold, and combinations thereof to form a porous frequency adjustor. Materials and forming capabilities for forming a frequency adjustor in this manner are readily available from GenPore, 1136 Morgantown Rd., P.O. Box 380, Reading, Pa. 19607, or ANVER Corp., 36 Parmenter Rd, Hudson, Mass. 01749. Suitable materials for construction of the frequency adjustor include ceramic, plastic, rubber, metal, silicon and other materials apparent to one of skill in the art upon reading this disclosure. In one embodiment, the surfaces of the frequency adjustor that are in contact the fluid can be coated with a material that is phobic to the fluid. For example, if the frequency adjustor is to be placed in water, then the surfaces of the frequency adjustor can be coated with one or more hydrophobic materials, such as a silane. In certain embodiments, the material can of a type where static forces retain a small amount of gas in contact with at least a portion of the frequency adjustor material.

In one embodiment, a frequency adjustor made from a porous material includes a at least one flow passageway, e.g., a central bore. This is because exhaled gas typically follows the path of least resistance and therefore a central bore permits maximum usage of the pores present in a volume of material to thereby reduce exhalation effort.

Figure 2:
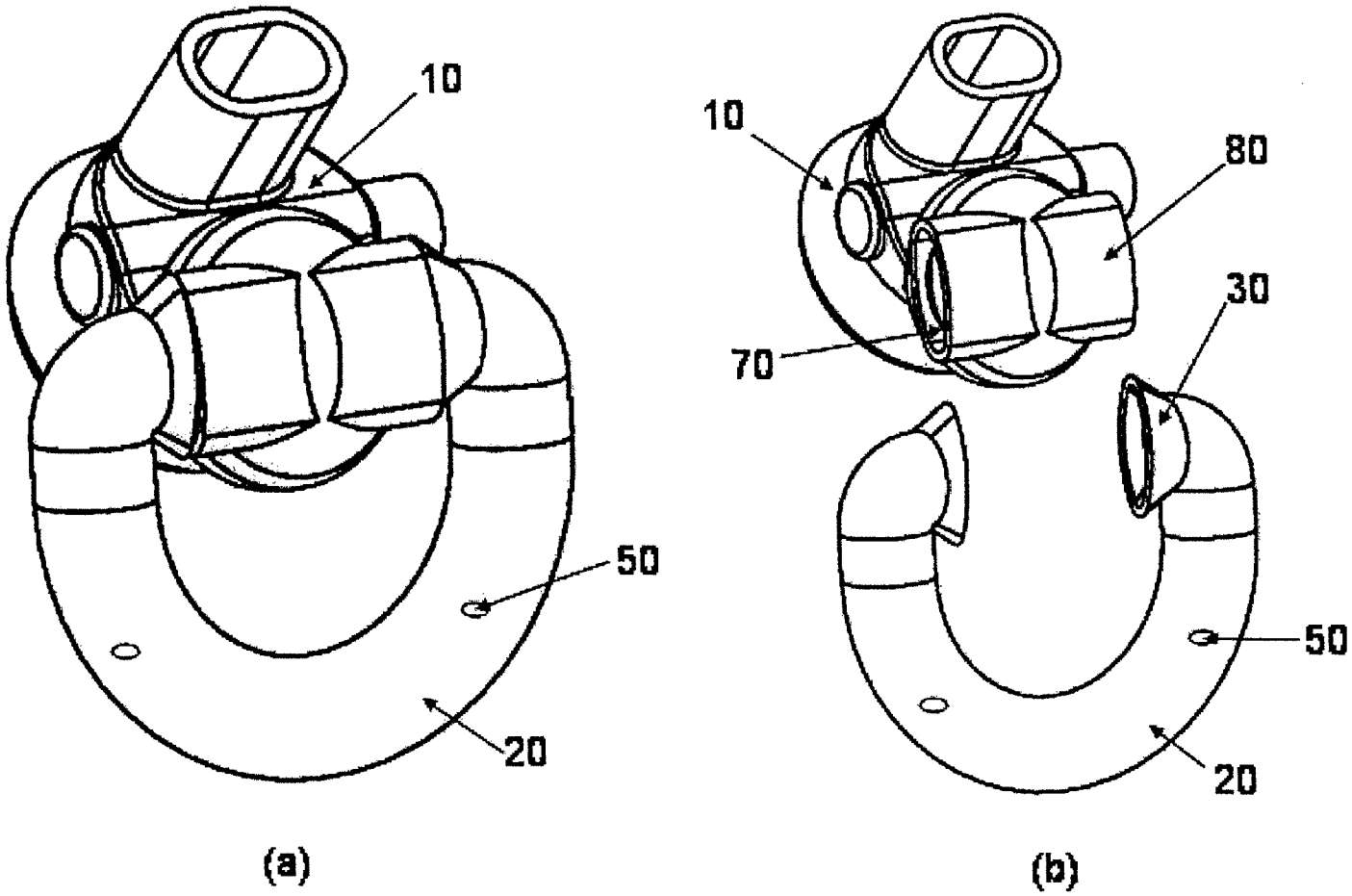
FIG. 2 represents a frequency adjustor coupled to a regulator.

One such embodiment is shown in FIG. 2, where a porous material of frequency adjustor 20 is coupled to regulator 10 via connection 30. Frequency adjustor 20 then is positioned under the chin of the diver. Thus, in one embodiment, the opening(s) 70 of a bubble diverter 80 of a conventional second stage regulator can be sealingly connected to a frequency adjustor of the present invention. The connection can be a compression fit or employ elastic bands or the like. In one embodiment, it is envisioned that a frequency adjustor of the present invention can be retrofit to an existing regulator using a "stethoscope" type engagement, where one or two or more conduits, which at one end are connected to a frequency adjustor, sealingly compress the conduit(s) open end into the openings of a bubble diverter. Other types of connections can also be used, as described below. Frequency adjustor 20 can also have one or more pores 50 optionally included.

In another embodiment, at least a portion or entire bubble diverter of a conventional second stage regulator can be replaced with a frequency adjustor of the present invention. In such embodiments, the frequency adjustor can then be permanently affixed to the second stage or removably affixed to the second stage in place of a bubble diverter. If the conventional bubble diverter and/or frequency adjustor are to be removably affixed, the attachment can be by any fittings suitable for use in the present invention and include a snap fit, pressure fit, bayonet fit, ball bearing and groove fit (e.g., quick connect pressure hose and power inflator connection type fitting), etc. To prevent leakage, such removable frequency adjustors may further include one, two or more O-rings.

Figure 5:
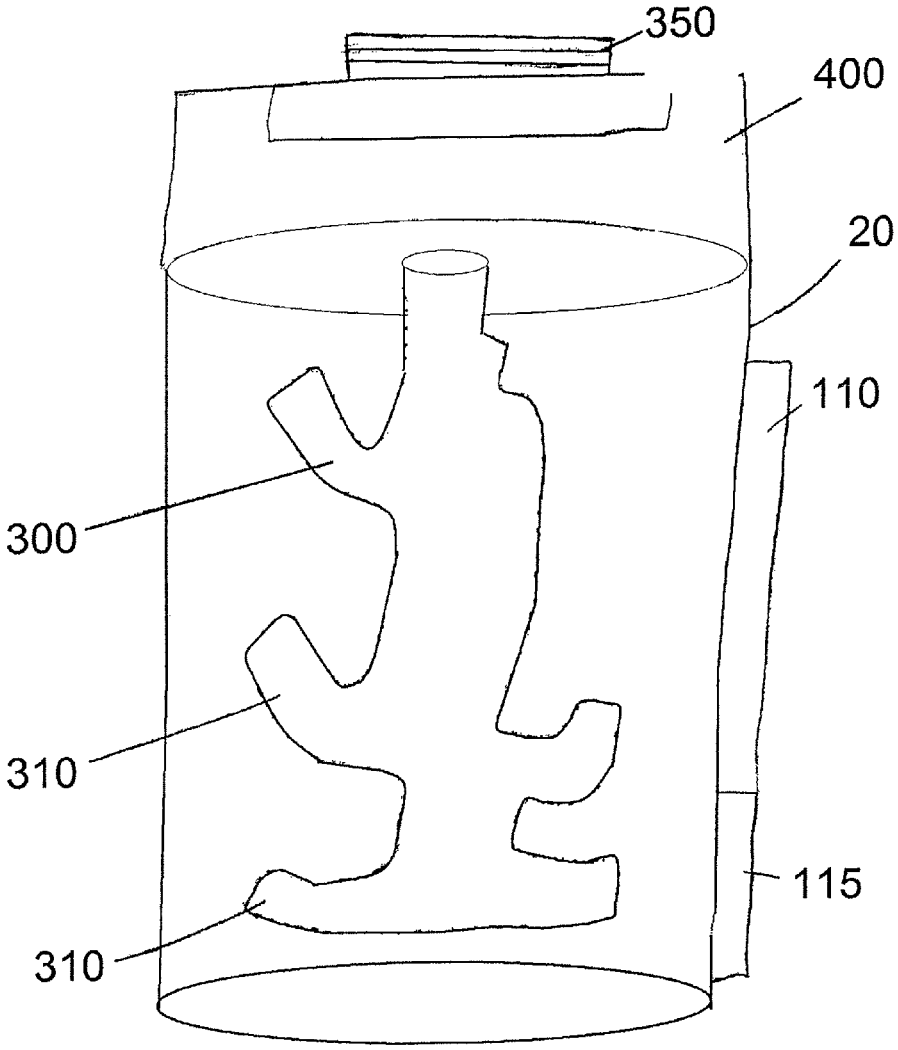
FIG. 5 represents an internal view of a frequency adjustor having a check valve and through-bore and transducer coupled thereto.

In one embodiment shown in FIG. 5, the frequency adjustor 20 includes through bore 300 having one or more additional flow passageways 310. Additionally, check valve 400 which also includes a connection point 350 for connection to conduit 60 is also shown. Transducer 110, having a water tight sealed power pack 115 (described in more detail below), is also shown coupled to frequency adjustor 20.

It should be noted that in certain embodiments, to minimize backpressure and inadvertent bubble noise, the volume between the check valve 400 and frequency adjustor 20 should be minimized. In certain embodiments, the frequency adjustor can be located proximal to the first stage. In other embodiments, the frequency adjustor can be located proximal to the second stage.

In certain embodiments, the frequency adjustor is formed by molding micronized plastic beads and applying heat to the plastic beads to cinter the beads together to form a porous structure. The average porosity (e.g., 100 microns) can be controlled by, at least, controlling the average size of the beads and/or amount of heat applied to the mold. Such techniques are apparent to one of skill in the molding arts.

In certain molded embodiments, at least a portion of interstitial spaces of the frequency adjustor are less than 100 microns in diameter. In another embodiment, at least a portion of the interstitial spaces of the frequency adjustor are between about 30 and about 100 microns in diameter. In one embodiment, at least a portion of the interstitial spaces are about 10, 20, 30, 40, 50, 60, 70, 80, 90, 100, 110, 120, 125, 150, 175, 200, 210, 220, 250, 300, 400, 500, 550, 600, 650, 800, 900 or 950 microns on average. In one embodiment, the interstitial spaces are between 100 and 500 microns, 100 and 600 microns, or 100 and 200 microns.

In another embodiment, at least a portion of the frequency adjustor material can be molded and then have a plurality of optional openings 50 drilled, (e.g., mechanical or laser drilled) or manufactured into the material to form pores of different sizes. In certain embodiments, the present invention can include at least a portion of material having openings or pores between about 100 microns and 1 mm, or 100 microns and 2 mm or 100 microns and 3 mm or 100 microns and 4 mm or 100 microns and 10 mm or 100 microns and 50 mm in diameter. In certain embodiments, the present invention can include openings in the frequency adjustor material having diameters between about 100 microns and 0.1 cm, or 100 microns and 0.2 cm, or 100 microns and 0.5 cm or 100 microns and 1.0 cm.

The formed pores embodiment and interstitial spaces embodiment can be used in a material alone or in combination. The apparent volume of a frequency adjustor is the volume of the adjustor if the adjustor was completely solid and non-porous. The real volume of the frequency adjustor is the apparent volume less the void volume. The void volume can be obtained by submerging the frequency adjustor in a known volume of water for 3 hours, agitating the frequency adjustor every 15 minutes to obtain the real volume. The void volume is then calculated by subtracting the real volume from the apparent volume. In other words, real volume+void volume=apparent volume, where the void volume includes the volume of porous spaces of the material itself and any and all hollow portions and flow passageways of the frequency adjustor. In certain embodiments, the frequency adjustor can have a void volume of more than 10%, 20%, 25%, 30%, 40%, 50%, 55%, 60%, 65%, 70%, 75%, 80%, 85%, 90%, or 95% of the apparent volume. In certain embodiments, the frequency adjustor can have a real volume of less than 10%, 20%, 25%, 30%, 40%, 50%, 55%, 60%, 65%, 70%, 75%, 80%, 85%, 90%, or 95% of the apparent volume. In certain embodiments, the real volume is less than the void volume and in certain embodiments the real volume is less than 10%, 15%, 20%, 25%, 30%, 35%, 40%, 50%, 55%, 60%, 65%, 70%, 75%, 80%, 85%, 90%, or 95% of the void volume.

In one embodiment, the material porosity is such that it slows the flow of fluid back into the void volume of the frequency adjustor. In one embodiment, the porosity of at least a portion of the frequency adjustor is such that a substantial portion of the void volume of the frequency adjustor remains free of fluid for a short time. Essentially, in such embodiments during inhalation or prior to exhalation, fluid does not completely fill the frequency adjustor or it takes more than 1 to 5 seconds to fill the void volume of the frequency adjustor. In certain embodiments, this feature prevents or reduces the formation of bubbles producing noise having a frequency between about 10 and 100 Hz within the attenuator itself during exhalation and also reduces exhalation effort.

In one embodiment, the porosity is such that the fluid (e.g., water or saltwater or other fluid having the same viscosity as freshwater or salt/seawater at room temperature) takes more than 1 to 5 or 1 to 3 seconds to flow back into and to at least begin to fill the void volume of the frequency adjustor. In one embodiment, the fluid takes more than 3 to 5 seconds to at least begin to fill the void volume of the frequency adjustor. In such embodiments, during a measured time period for fluid to flow back into the frequency adjustor (e.g., 1 to 5 seconds, 1 to 3 seconds, or 3 to 5 seconds), the void volume of the frequency adjustor can be less than 5%, 15%, 25%, 30%, 35%, 40%, 45%, 55%, 65%, 70%, 75%, 80%, 85%, or 95% filled with fluid during the measured time period. In yet another embodiment, during the measured time period water flows into the frequency adjustor and fills the void volume, where the volume of fluid that fills the void volume of the frequency adjustor is less than 5%, 15%, 25%, 35%, 45%, 55%, 65%, 75%, 80%, 85%, or 95% of the apparent volume. In one embodiment, more than 2 seconds are required to fill at least 95% of the void volume. In one embodiment, more than 3 seconds are required to fill at least 95% of the void volume. In one embodiment, more than 4 seconds are required to fill at least 95% of the void volume. In one embodiment, more than 5 seconds are required to fill at least 95% of the void volume. In yet another embodiment, more than 6 seconds are required to fill at least 95% of the void volume.

To test the fluid fill time of a frequency adjustor, the procedure is as follows. First a frequency adjustor having a known apparent volume and real volume should be completely dried and all traces of fluid removed, e.g., by allowing frequency adjustor to sit in a well ventilated and air conditioned room at room temperature for two days. Next, the portion of the frequency adjustor that receives exhaled air should be sealed. Additionally, all other openings (e.g., check valves or overpressure valves) that do not contribute to the average porosity of the frequency adjustor should also be sealed. Next, the frequency adjustor is completely submerged in water and held submerged, such that immediately upon completely submerging the frequency adjustor, the timing begins. It should be noted that the uppermost portion of the submerged frequency adjustor should be no more than 1 to. 2 inches below the surface of the water. After the elapsed measuring time, the frequency adjustor should be quickly removed (in 0.5 to 1 seconds) and placed in a beaker or flask. All water that collected within the void volume of the frequency adjustor should be allowed to drain into the beaker. The frequency adjustor can be unsealed and air can be forced through the material to urge water out of the porous spaces. After 15 minutes of drainage and collection, the volume of water can be measured and compared against either the void volume or apparent volume of the frequency adjustor. Because the exhaled gas typically enters the frequency adjustor at or about ambient pressure, pressure fluctuations that may cause a variation on timing is de minimus so long as the pressure of gas initially within the frequency adjustor is at about the same pressure as ambient pressure in the water column.

In certain embodiments, the thickness of at least a portion of the material of the frequency adjustor can be at least 1 mm, 2 mm, 5 mm, 7 mm, 10 mm, 1.1 cm, 1.2 cm, 1.5 cm, 1.8 cm, 0.125 in, 0.20, 0.25 in, 0.30 in, or 0.35 in., or 0.45 in. In one embodiment, a portion of the material has a wall thickness of between 0.125 inches and 0.45 inches.

Typical diver exhalation lasts about 2 to 5 seconds, with some minor variations based on exertion and body size. Accordingly, in certain embodiments, at least 50% of the volume of gas exhaled by a diver exits the frequency adjustor and enters a surrounding fluid over the duration of a diver exhalation, e.g., about 2 to 5 seconds. In one embodiment, at least 60% of the volume of gas exhaled by the diver enters the fluid over a 2 to 5 second interval (hereafter "over 2 to 5 seconds"). In one embodiment, at least 70% of the volume of gas exhaled by the diver enters the fluid over 2 to 5 seconds. In one embodiment, at least 75% of the volume of gas exhaled by the diver enters the fluid over 2 to 5 seconds. In one embodiment, at least 80% of the volume of gas exhaled by the diver enters the fluid over 2 to 5 seconds. In one embodiment, at least 85% of the volume of gas exhaled by the diver enters the fluid over 2 to 5 seconds. In one embodiment, at least 90% of the volume of gas exhaled by the diver enters the fluid over 2 to 5 seconds. In one embodiment, at least 95% of the volume of gas exhaled by the diver enters the fluid over 2 to 5 seconds. In one embodiment, at least 98% of the volume of gas exhaled by the diver enters the fluid over 2 to 5 seconds.

In one embodiment, gas exiting the frequency adjustor is measured after exhalation and/or during inhalation. This is because in certain embodiments, very little gas (e.g., exhaled air) that enters the frequency adjustor or a component of the present invention is restrained, purposefully retained or trapped within the frequency adjustor itself. In certain embodiments, such gas is also not restrained after exhalation or prior to contact with the frequency adjustor, because such trapping could lead to uncontrollable diver buoyancy. Specifically, in certain embodiments exhaled gas is free to pass through the walls of the frequency adjustor and therefore is not trapped or retained in the system after exhalation and does not substantially or appreciably affect diver buoyancy, and when placed in or submerged into a liquid environment the buoyant forces/properties of the gas (i.e., gas rises) are sufficient to urge the gas to exit the frequency adjustor without imparting a substantial buoyancy force on the diver. In certain embodiments, the gas does not need to overcome any sealing mechanical properties. On a percentage basis, at least 30%, 40%, 50%, 60%, 70%, 85%, 90%, 95%, or 98% of the volume of gas exhaled by a diver exits the frequency adjustor and enters a surrounding fluid over the time period of a single exhalation and of the remainder, 30%, 40%, 50%, 60%, 70%, 85%, 90%, 95%, or 98% exits the frequency adjustor via buoyancy or other forces (e.g., shearing caused by moving the divers head and friction with the surrounding fluid) during diver inhalation or any pauses between diver exhalations. Any remainder is typically forced out during the next exhalation of the diver.

Moreover, to further reduce backpressure, reduce exhalation effort and to permit maximum flow of exhaled gas through the frequency adjustor the pore size can be increased or the overall size of the frequency adjustor can be increased, and thereby the overall length of any flow passageways (e.g., through-bore 300) that may be present, can be increased. Additionally, the thickness of the wall formed by flow passageways may be decreased or increased.

In one embodiment, the sound pressure level (SPL) of the sound produced by the bubbles is also adjusted. In one embodiment, the SPL of sound (in dB re 1 μPa) is adjusted to a product of (0.1*(one or more numbers chosen from the set of 1.01, 1.1, 1.2, 1.3, 1.4, 1.5, 1.6, 1.7, 1.8, 1.9, 2, 3, 4, 5, 6, 7, 8, 9, 10, 11, 12, 13, 14, 15, 16, 17, 18, 19, and 20, wherein a number can be chosen as part of the product set more than once). For example, 0.1*12*1.1*1.1*10=14.52 dB re 1 μPa.

In one embodiment, one or both of SPL and frequency are adjusted such that the spectral density (mean square pressure per unit bandwidth) in micropascals per hertz approximates the background spectral density. For example, the micropascals per hertz (dB re 1 $\mu Pa^2/Hz$) value approximates the background spectral density.

Sound Production

In one embodiment, the frequency and/or volume of a particular frequency or the percentage of sound produced in the spectrum of frequencies between 10 and 100 HZ is adjusted to thereby approximate the frequency and/or volume of sound present as background noise in the fluid into which the bubbles are released.

In one embodiment, the frequency adjustor reduces the frequency of the sound produced by at least a portion of the bubbles to less than 10 Hz. In one embodiment, the frequency adjustor reduces the frequency of the sound produced by the bubbles to between 0.1 and 10 Hz.

In another embodiment, the frequency adjustor adjusts at least a portion of the frequency of the sound produced by at least a portion of the bubbles.

In one embodiment, the increase is to greater than 100 Hz, e.g., greater than or equal to 101 Hz. In one embodiment, the frequency adjustor alters the frequency of sound produced by exhaled gas by increasing the amount of sound produced by the bubbles to above 105 Hz and by reducing the amount of sound produced by the bubbles between 10 and 100 Hz.

In one embodiment at least a portion of the frequency of the sound is adjusted to 105 Hz to 1000 Hz or 10,000 Hz. In another embodiment, the frequency of the sound is adjusted to 120 Hz to 800 Hz. In another embodiment, at least a portion of the frequency of the sound is adjusted to 120 Hz to 800 Hz. In another embodiment, at least a portion of the frequency of the sound is adjusted to 200 Hz to 500 Hz. In another embodiment, at least a portion of the frequency of the sound is adjusted to 105 Hz to 2000 Hz. In one embodiment, at least a portion of the frequency of the sound is adjusted to greater than 105 Hz. In another embodiment, at least a portion of the frequency of sound is adjusted to greater than 110 Hz. In another embodiment, at least a portion of the frequency of sound is adjusted to greater than 120 Hz. In another embodiment, at least a portion of the frequency of sound is adjusted to greater than 130 Hz. In another embodiment, at least a portion of the frequency of sound is adjusted to greater than 140 Hz. In another embodiment, at least a portion of the frequency of sound is adjusted to greater than 150 Hz. In another embodiment, the frequency of sound is adjusted to greater than 200 Hz. In another embodiment, at least a portion of the frequency of sound is adjusted to a Hz frequency greater than the product of (100*(one or more numbers chosen from the set of 0.8, 0.9, 1.1, 1.2, 1.3, 1.4, 1.5, 1.6, 1.7, 1.8, 1.9, 2, 3, 4, 5, 6, 7, 8, 9, 10, 11, 12, 13, 14, 15, 16, 17, 18, 19, and 20, wherein a number can be chosen as part of the product set more than once)). For example, 100*1.2*1.2*10*10=14400 Hz or 14.4 KHz; or 100*1.1=110 Hz.

The sound produced by the bubbles emanating from a frequency adjustor of the present invention can be measured graphically and such graphical representation can be used as a basis for comparing noises produced by bubbles. In one embodiment, the frequencies of the sound produced by bubbles can be measured and shown on a scale of intensity or volume vs. frequency (x-axis) and then compared to a baseline measurement, i.e., the area under the curve between 10 Hz and 100 Hz in the absence of an embodiment of the invention can be used as a baseline for comparison. In certain instances, the area under the curve can be calculated for a moment in time (instantaneous) or averaged over a period of time, for example the duration of one exhale (e.g. about 3 to 5 seconds). Accordingly, in certain embodiments of the present invention, the area under the curve relative to a baseline measurement in the 10 Hz to 100 Hz range can be reduced by a percentage. In certain embodiments the area under the curve (AUC) that is produced by measuring bubble noise in the 10 to 100 Hz range emanating from an embodiment of the current invention can be about 5, 10, 15, 20, 25, 30, 35, 40, 45, 50, 55, 60, 65, 70, 75, 80, 85, 90, 95, 97 or 99 percent less than the area under the baseline curve. Any of the preceding values may be chosen for use in the present invention for baseline comparative purposes. For example, in one embodiment, the AUC may be 55 percent less. In another embodiment the AUC may be 75 percent less than the baseline AUC.

It should be noted that water itself can attenuate sound, and the amount of attenuation roughly follows the square of the frequency. Thus, low frequency sounds (e.g., between about 10 and 100 Hz) is less attenuated by the surrounding water than higher frequencies. Without intending to be bound to theory, it is believed that this is the reason why fish exhibit a startle response even at longer distances, because the low frequency sound waves pass more easily through the water. Accordingly, by reducing or eliminating the sounds at the lower frequency range (e.g., between about 10 Hz to 100 Hz), and relying on the surrounding fluid (e.g., water/seawater) to attenuate the higher sounds that are made, the efficiency and utility of the device of the present invention can be further improved.

For example, in certain embodiments, the noise produced in the spectrum of 10 to 100 Hz is reduced by, at least, e.g., 10%, or 20%, or 30%, or 40%, or 50%, or 60%, or 70%, or 80%, or 90%, or 95%, or 99%, and e.g., 50%, or 60%, or 70%, or 80%, or 90%, or 95%, or 99% of the noise produced (as calculated by an area under the curve analysis, as described above) is less than 500 or 600, or 800, or 1000 or 2000 Hz and also greater than 105, or 110, or 120 or 130 Hz.

In one embodiment, frequency adjustment of the sound produced by exhaled gas bubbles can be accomplished by adjusting the size of the bubbles formed. In one embodiment, the size of the bubbles formed can be reduced by using a porous material having interstitial spaces such that as the exhaled gas passes through and exits the porous material, small bubbles are formed. Suitable porous materials can be made from ceramic, plastic (e.g., polypropylene or polyethylene or combinations thereof), rubber, metal or other materials apparent to one of skill in the art upon reading this disclosure. Such materials may be molded or machined depending upon the particular tools available and needs of the user.

C. (2) Active Noise Cancellation

In one embodiment, the present invention includes active noise cancellation. The active noise cancellation can be used alone or in combination with the frequency adjustor described above.

Modern active noise control is achieved through the use of a computer, which analyzes the waveform of the noise, then generates a polarization reversed waveform to cancel it out by interference. This waveform has identical or directly proportional amplitude to the waveform of the original noise, but its polarity is reversed. This creates the destructive interference that reduces the amplitude of the perceived noise. The waveform to be reduced or cancelled can be sensed by a first transducer, which sends a signal to the computer for analysis. Once analyzed, the computer initiates commands to send a signal back to a transducer (which may be the same or different transducer as the first transducer), to produce a waveform that will cancel all or at least a portion of the sensed waveform.

It has been found that active noise control is particularly suitable for low frequency sounds, such as the frequency of sound produced by the bubbles of a diver's exhaled gases, inadvertent noises caused by a diver (e.g., inadvertent diver equipment contact with other equipment), or bubbles produced by the frequency adjustor described above. In one embodiment, the wave or waves produced by the one or more underwater speakers of the present invention cancel 10% to 90% of the noise (e.g., one or more of: bubble noise, finning noise, inadvertent equipment contact noise, etc.) generated by a diver. In one embodiment, the amount of noise cancelled relative to the noise produced in the absence of an attenuator can be expressed as a percentage having a value, wherein the value is a product of: (5*(one or more numbers from the group of 0.2, 1, 2, 3, 4, 5, 6, 7, 8, 9, 10, 11, 12, 13, 14, 15, 16, 17, 18, 19 and 20, where each number in the group can be used more than once), with a maximum value of 100. For example, 5*0.2*9*11=99 (i.e., 99%).

In one embodiment, a noise-cancellation speaker (e.g., an underwater speaker or transducer) may be co-located with the sound source which is the source of the noise to be reduced or cancelled. In a related embodiment, the power level of the sound emanating from the underwater speaker is the same as the source of the unwanted sound. It should be noted that noise cancellation at other locations is more difficult as the three dimensional wavefronts of the unwanted sound and the cancellation signal could match and create alternating zones of constructive and destructive interference.

Accordingly, in one embodiment, one or more of the underwater transducers (e.g., hydrophone or underwater speaker or underwater microphone) is located at the noise production point, e.g., at or near the regulator exhaust port, or if in combination with a frequency adjustor at or near the position exhaled gas enters the environment, or on or adjacent to or integral with a frequency adjustor of the invention.

In view of the teachings herein, underwater transducers suitable for use in the present invention can be readily developed. Transducers (e.g., hydrophones) and equipment for recording waves and reproducing waves in a fluid are readily available from commercial manufacturers, including BIOACOUSTICS, 3 Noyes Avenue, Mattapoisett, Mass. 02739, and SONATECH, Inc., 879 Ward Drive, Santa Barbara, Calif. 93111-2920. In one embodiment, the present invention includes only one hydrophone, which can be used as either (a) a speaker only; or (b) a speaker and receiver/underwater microphone. In another embodiment, the present invention includes two or more hydrophones, where at least one hydrophone functions as an emitter and at least one hydrophone functions as a receiver of sound waves.

In certain instances it may be preferable to pre-specify the power level and/or frequency of sound to be emitted from the device of the present invention. For example, the frequency of sound attributable to a particular diver using a particular regulator can be pre-analyzed such that a specific cancellation waveform can be input and stored in a memory. Upon actuation, by e.g., receiving a signal from a transducer, the computer initiates commands to emit a waveform that corresponds to the stored waveform. In this embodiment, the need for continuous analysis of received waveforms is therefore eliminated. One or more waveforms that correspond to one or more divers can be stored in this manner in a memory coupled to a particular attenuator such that different divers can use the same attenuator by selecting the waveform specific to the diver.

In another embodiment, a waveform attributable to a diver (either the waveform produced by the diver or the waveform that cancels the waveform produced by the diver) can be stored in a mobile storage medium (USB or flash memory, etc.) such that a waveform can be uploaded at a later time to a memory accessible by the attenuator control computer. Such uploading can occur via an electronic communication port, e.g., USB, IR communication port, ethernet, etc.

In one embodiment, using an underwater transducer the present invention continuously records sounds produced by the diver or the diver's environment. In this manner, a profile of a specific diver having specific equipment can be developed to optimize a custom waveform useful to cancel that particular diver's noise.

In one embodiment, the attenuator can be in an "active" mode such that the waveform is continuously adjusted based on noise production.

D. Attachment and Embodiments

As described above, the frequency adjustor and underwater transducer can be used, each either alone or in combination.

In certain embodiments, the frequency adjustor and/or underwater transducer can be attached or coupled directly to a diver's regulator. Such attachment can de direct or indirect. In one embodiment, the frequency adjustor and/or underwater transducer can be attached to the regulator via compression fit on either side of the regulator exhaust ports or attached directly to the regulator using any attachment method apparent to one of skill in the art upon reading this disclosure. In one embodiment, the frequency adjustor is coupled to the first stage via a sealing rotational or snap fit. In certain embodiments, a frequency adjustor of the current invention replaces the standard bubble diverter on conventional second stage regulators.

Figure 4:
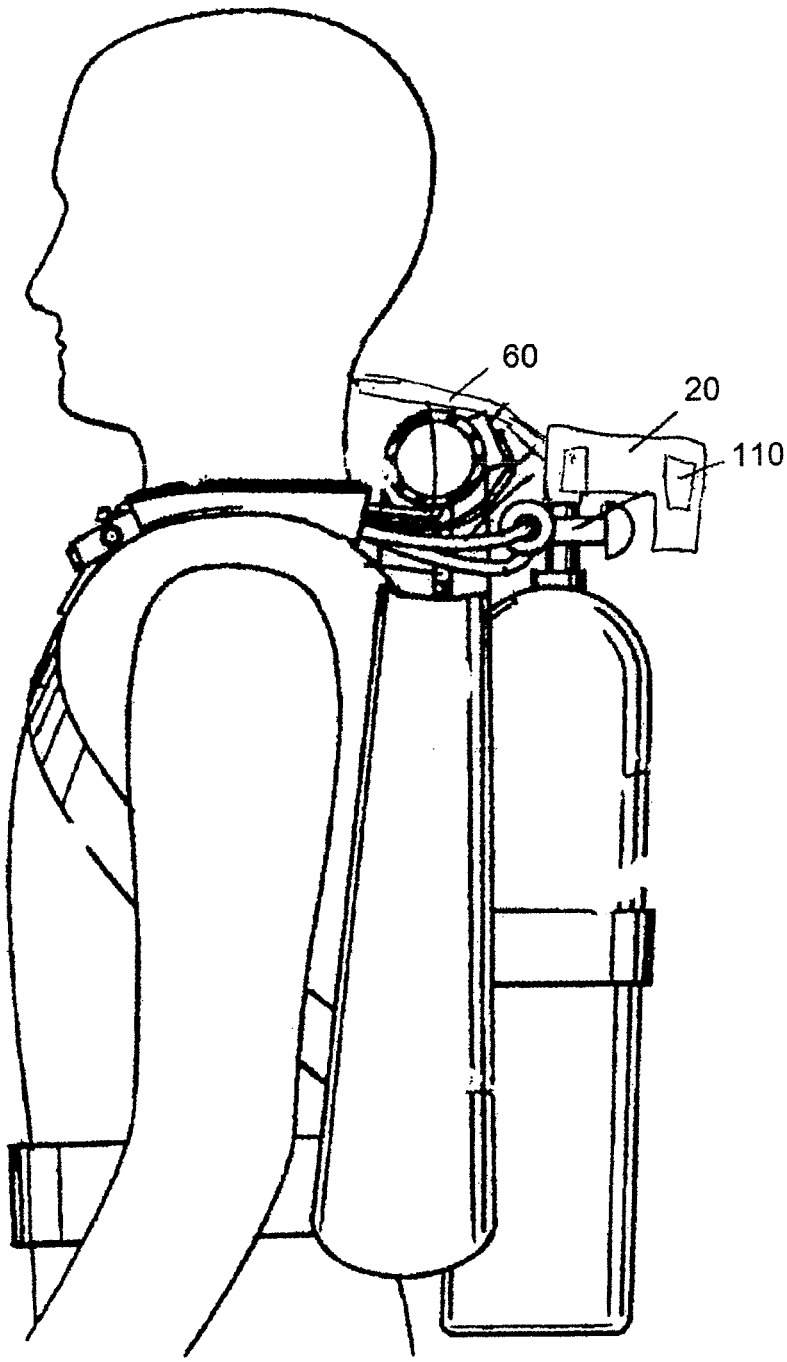
FIG. 4 represents a frequency adjustor and attenuator placement.

In one embodiment, the frequency adjustor and/or underwater transducer are located distal from the regulator. In such an embodiment, the frequency adjustor and/or underwater transducer can be attached to the first stage, as shown in FIG. 2, or elsewhere on the back of the diver, as shown in FIG. 4, to thereby keep any excess equipment away from the face of the diver. Moreover, by locating the frequency adjustor and/or underwater transducer at or near the first stage, as shown in FIG. 4, any bubbles produced, either by the frequency adjustor or as the bubbles exit the system near the underwater transducer, the bubbles will rise starting from behind the diver and typically not be visible to the diver. Moreover, the divers own body will absorb at least a part of the sound and alter the apparent source direction of the noise to animals that can sense underwater noise directions.

Figure 3:
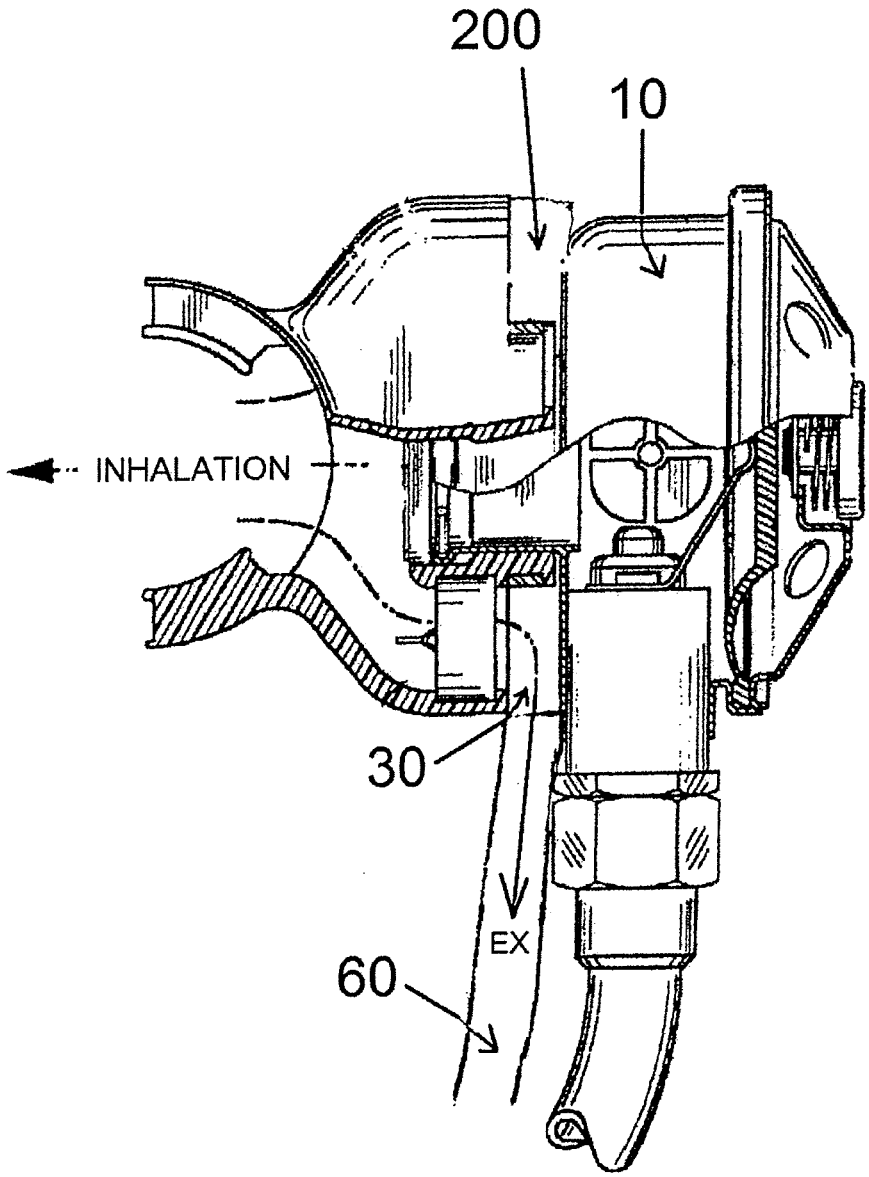
FIG. 3 represents a regulator coupled to a frequency adjustor via a conduit.

With reference to FIGS. 3 and 4, in an embodiment where the frequency adjustor 20 and/or underwater transducer 110 are distal from the regulator, the frequency adjustor 20 and/or underwater transducer 110 are typically connected to the regulator via a conduit 60, wherein the conduit can be sealingly coupled to at least one exhaust port of the regulator 10. In an embodiment where the conduit 60 is coupled to only one exhaust port, it may be necessary to seal or close off any remaining exhaust ports if the regulator includes more than one exhaust port, as explained with reference to FIG. 8. Accordingly, in certain embodiments a plug 200 or switch 800 for one or more regulator exhaust ports can be used.

The conduit can be coupled to the exhaust port via a removable o-ring "snap fit" type engagement, in a mating arrangement, a screw type fitting or a jacket type seal, much like the wrist and neck seals of a drysuit. In certain embodiments, exhaled gases should not be permitted to escape from the regulator unless such exhaled gases produce bubbles that produce a noise of greater than about 100 Hz or less than 10 Hz. For connecting the conduit to the regulator exhaust port, certain embodiments that are preferable include those that can be quickly removed to open up the regulator exhaust ports in the event of equipment malfunction. Alternatively, one or more valves can be placed at or near the connection point of the frequency adjustor and/or underwater transducer to immediately open up regulator exhaust to the environment. These one or more valves can also be used as openings to insert cleaning tools and the like.

In order to provide a sealing arrangement, the first or second stage regulator or attenuator can include a manual or electric switch having at least two engagement positions. In other embodiments, the first or second stage regulator or attenuator includes a switch having at least three engagement positions. In a first position the regulator exhaust port(s) are open to a fluid and function in a normal manner, producing noise at a frequency described above. In a second position, the exhaust ports are closed and sealed, thereby forcing exhaled gas to enter the attenuator (which may be directly or indirectly coupled to the housing/body of the second stage regulator) or an exhaust gas conduit which is in fluid (e.g., gas or liquid fluids) communication with the regulator. In the second position, at least a portion of the exhaled gas is then urged via exhalation pressure or buoyancy forces toward the frequency adjustor and/or attenuator. An optional third position seals both the regulator and exhalation gas conduit, which during an exhalation thereby forces liquid which is retained in a volume of the second stage regulator out through a check valve located in the regulator housing. Alternatively, one, two or three or more sliding gates can be used to open and close the attenuator. Like a miniature sliding door, the gates can be used to open and close portions of the attenuator or other component of the present invention.

The exhalation conduit can be cleared with gas by actuating a another switch that urges gas from the regulator or inhalation conduit directly into the exhalation conduit, thereby clearing at least a portion of any accumulated fluid from the exhalation conduit. Backflow of conduit clearing gas into the regulator housing can be prevented by a check valve.

Once the second stage and exhalation conduit are clear of a substantial portion of fluid, the switch can be returned to the second position. If a user wants to return to normal regulator use, the switch can be returned to the first position, thereby unsealing the second stage, flooding the volume in the second stage and optionally the exhalation conduit.

Figure 8:
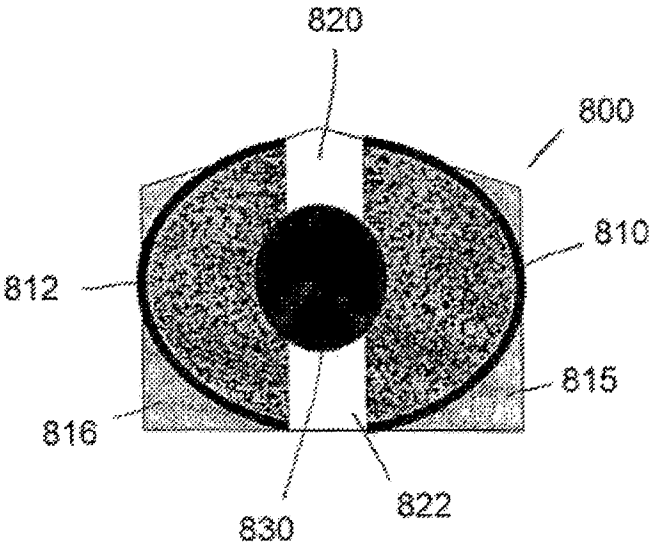
FIG. 8 represents a switch for sealing a second stage regulator to thereby engage a frequency adjustor.

FIG. 8 represents a top down view of switch 800 for sealing a second stage regulator to thereby engage a frequency adjustor in the manner explained above. A switch for use in the present invention can be any type, including rotary and flip switch types. Shown switch 830 includes three rotary positions. The positions are referred to as "open", "closed" and "clear", with reference to the functions of each position as described in the preceding paragraphs. As shown in FIG. 8, exhaled/exhaust gas normally exits a second stage via sides 815 and 816. However, when sealing portions 810 and/or 812 are engaged, the regulator is sealed from the external environment such that exhaled gas can only exit the regulator through an exhaled gas conduit (not shown), which transports exhaled gas to a frequency adjustor typically mounted or coupled to a first stage regulator, as explained herein. When a frequency adjustor is not desired to be used, switch 830 can be turned such that openings 820 and 822 engage sides 815 and 816, thereby opening the regulator to the external environment. An optional "clear" position engages a check valve (not shown) such that water present in the housing can be expelled from the housing through a housing check valve, and also so that the exhaled gas conduit can be cleared as explained above. Switch 830 can be directly coupled, glued, machined or formed in situ, placed or molded integral with an attenuator. In one embodiment, switch 830 is a manual switch that is formed integrally with the attenuator during attenuator formation described herein. In one embodiment, switch 830 is placed or positioned in a mold with the attenuator material which is then heated to fix switch 830 into a desired position in the attenuator.

Figure 9:
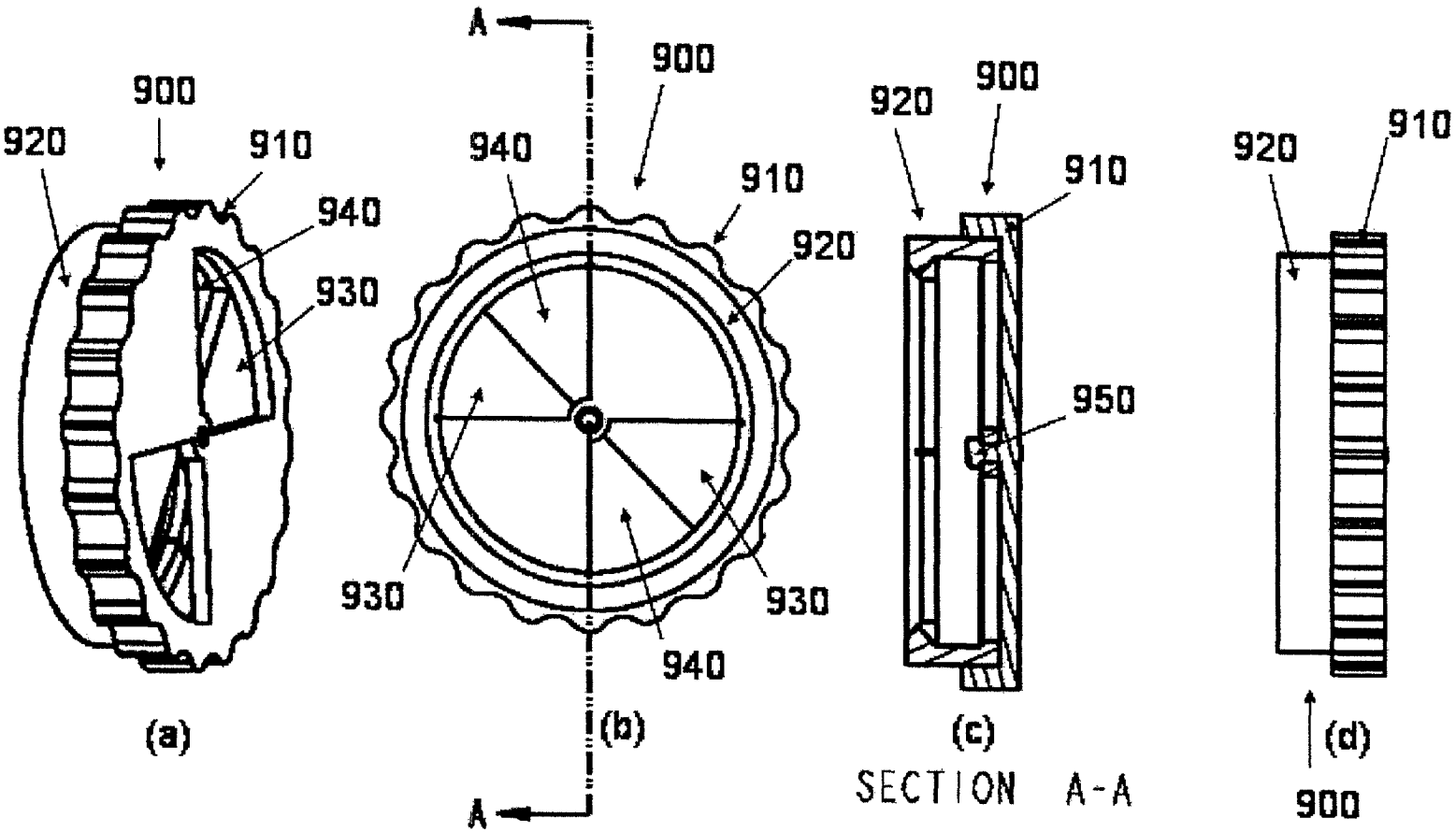
FIG. 9 represents an alternative embodiment of the switch of FIG. 8.

FIG. 9 shows an alternative embodiment to the switch in FIG. 8. Switch 900 includes two primary positions, "open" and "closed", but as shown in FIG. 9, partially open or partially closed positions are contemplated and shown by sealing portion 930 and openings 940. The two position switch is contemplated for embodiments where the frequency adjustor is mounted on the second stage regulator. Gripping ridges 910 can be used to turn the face of the switch 900 in a dial like fashion to crack or seal the regulator about coupling portion 920 to thereby engage sealing portion 930. FIG. 9(*a*) is a perspective view of switch 900. FIG. 9(*b*) is a back view of switch 900, showing partially opened openings 940. FIG. 9(*c*) is a section view of FIG. 9(*b*) showing coupling portion 920 and gripping ridges 910. FIG. 9(*c*) also shows rotation point 950, about which the face of switch 900 turns clockwise and/or counterclockwise to crack and/or seal the present invention. FIG. 9 (*d*) shows a side view of switch 900.

Figure 10:
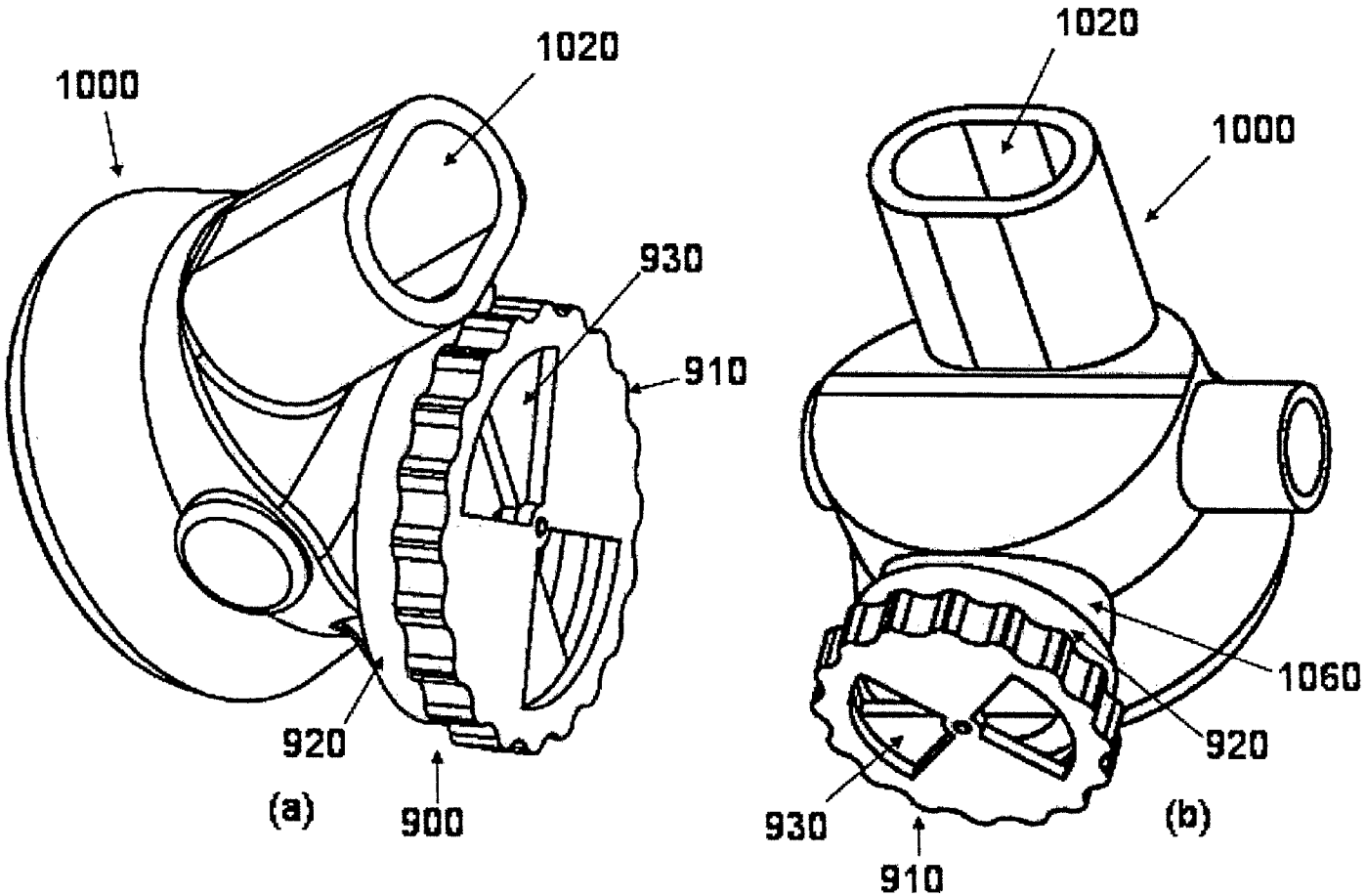
FIG. 10 represents a second stage regulator having the switch of FIG. 9 coupled thereto.

Switch 800 or 900 can be made from any suitable nonporous material and can be sealingly coupled to a frequency adjustor that is in turn coupled to a second stage regulator. Alternatively, in certain embodiments switch 800 or 900 can be made in whole or in part from a porous material described herein. In embodiments where switch 800 or 900 are made from porous material, the switch itself can also function as a frequency adjustor of the present invention. FIGS. 10 (*a*) and (*b*) show embodiments of the present invention having a frequency adjustor directly coupled to the second stage regulator 1010. A user inhales and exhales through port 1020 and can use switch 900 to either direct exhaled gas through the switch itself or alternatively through a conduit (not shown). FIG. 10 (*a*) shows an embodiment where switch 900 includes at least a portion of the frequency adjustor material described herein. FIG. 10 (*b*) shows additional frequency adjustor portion 1060. As described above, switch 900 in FIG. 10 (*b*) may optionally also include at least a portion of the frequency adjustor material.

Figure 11:
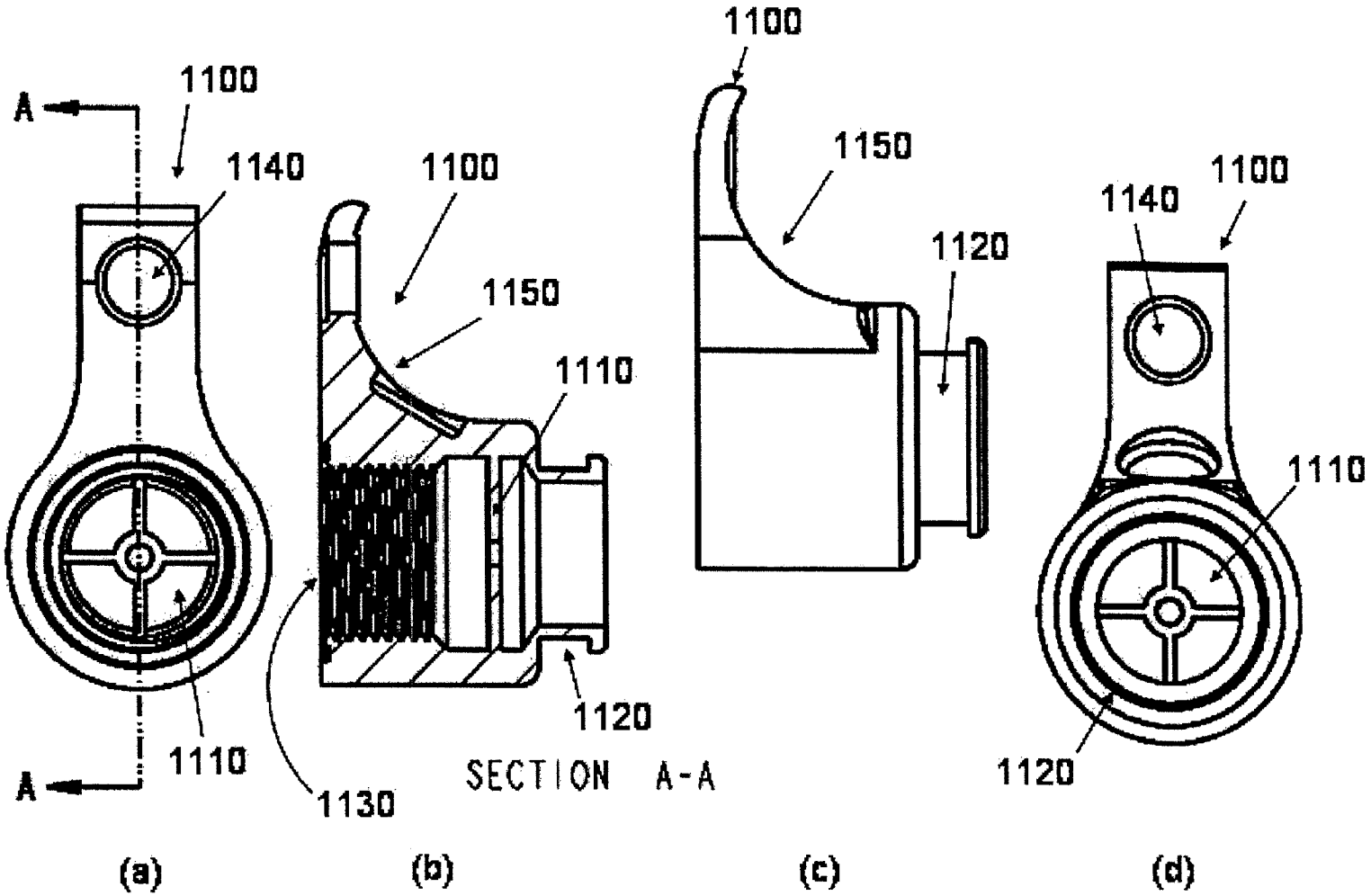
FIG. 11 represents a manifold for use with the present invention.

FIG. 11 shows an alternative structure for a manifold such as that shown in FIG. 7. Manifold 1100 includes o-ring screw hole 1140 for attachment to a first stage regulator. Curve 1150 is shaped to fit the profile of the first stage. As shown in FIG. 11(*a*), the manifold 1100 can include a check valve 1110 to prevent fluid from filling a conduit witch is typically coupled to the manifold by a sealing ring or quick connect at sealing portion 1120. Section view of FIG. 11(*b*) shows threads 1130 for attachment of a frequency adjustor as explained with reference to FIG. 12. FIG. 11 (*c*) is a side view of manifold 1100 and FIG. 11 (*d*) is a bottom view of manifold 1100. In certain embodiments, a screw (not shown) can also be used to retrofit connect manifold 1100 to an existing first stage by inserting a screw through hole 1140 and into a low pressure opening of a first stage regulator.

Figure 12:
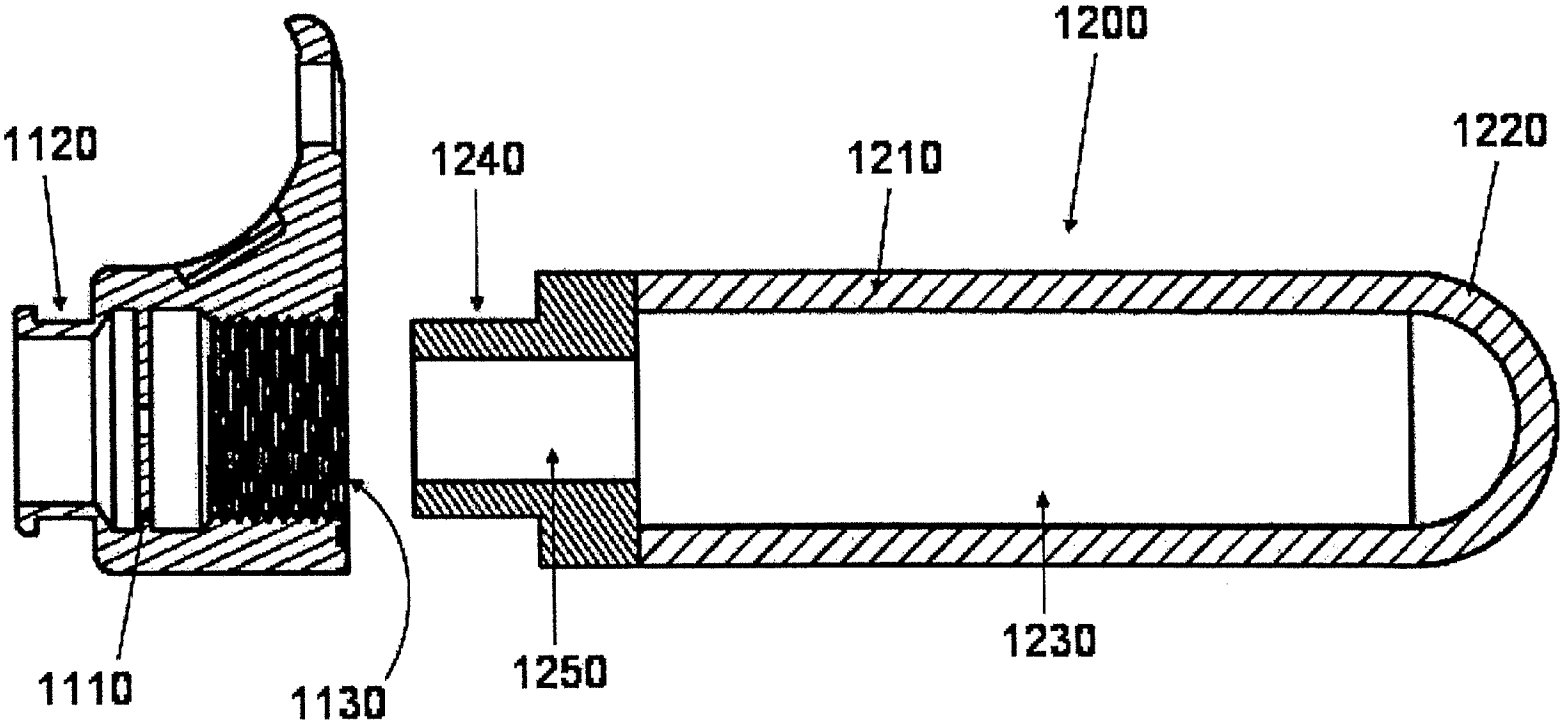
FIG. 12 represents a section view of a manifold and frequency adjustor of the present invention.

FIG. 12 shows a section view of manifold 1100 and tubular frequency adjustor 1200. Attachment portion 1240 of frequency adjustor 1200 can screw into manifold 1100 and can form a seal. As shown, frequency adjustor 1200 includes a hollow portion 1230 and side wall 1210, having a thickness 1220. When assembled, exhaled air passes through check valve 1110 of the manifold, into inlet portion 1250 and then into hollow portion flow passageway 1230 then enters the fluid through porous side wall 1210. In between exhalations, check valve 1110 prevents fluid that may collect within flow passageway 1230 and inlet portion 1250 from filling the conduit (not shown) which connects manifold 1100 to the second stage.

Figure 13:
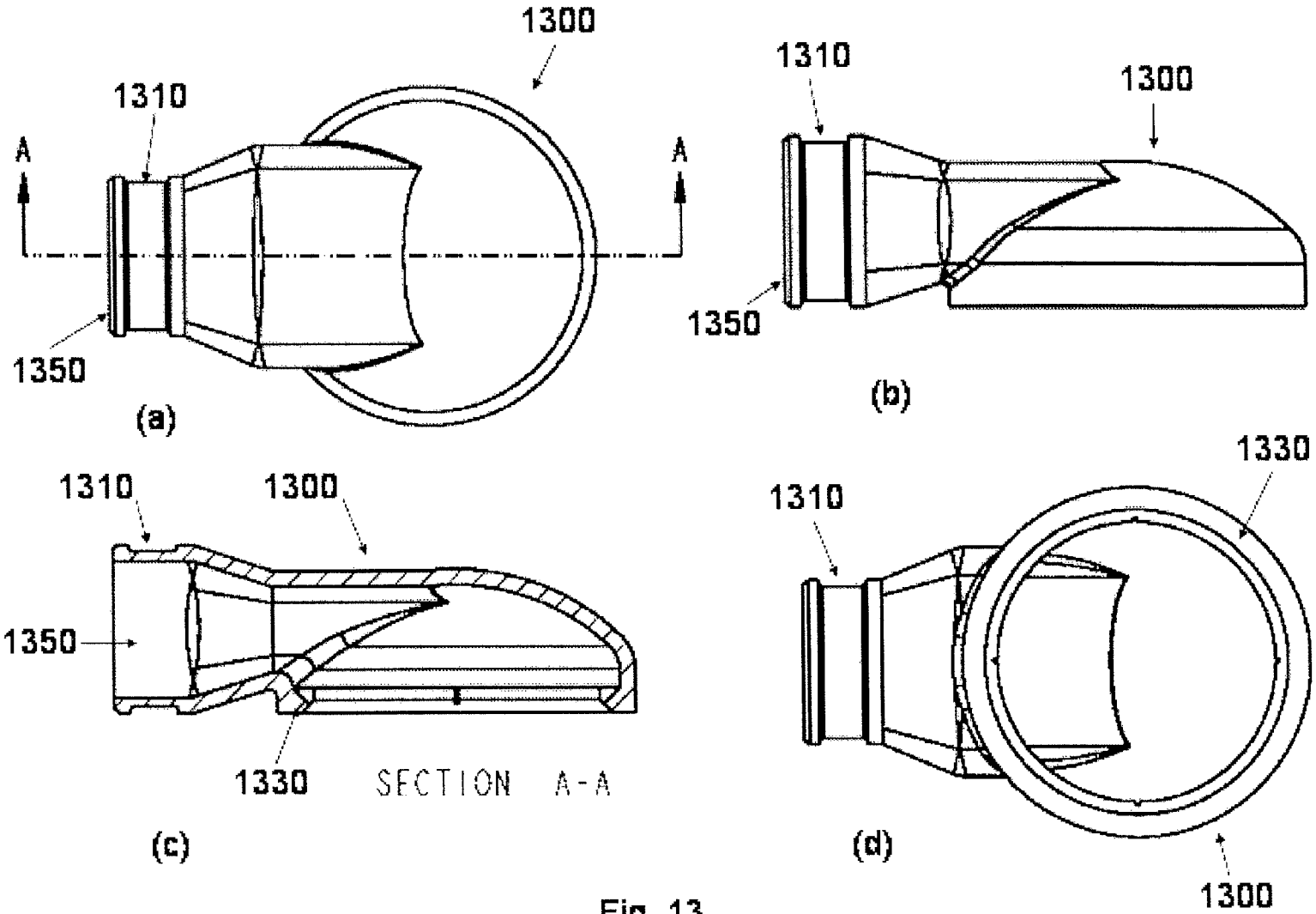
FIG. 13 represents a sealing cup for use with the present invention.

FIG. 13 shows a sealing cup 1300 for use in certain embodiments of the present invention. Sealing cup 1300 replaces an existing bubble diverter and seals against a second stage at seal 1330. Sealing cup 1300 may also couple to the exhalation port or port fitting of a conventional regulator if such a port or fitting exists. Rather than enter the fluid directly, exhaled air is redirected and exits sealing cup 1300 at exit

1350. Sealing cup 1300 includes sealing portion 1310 (which may be a quick connect or other type of sealing connection), to connect a conduit (not shown) from sealing cup 1300 to manifold 1100 such that the exhaled air that exits sealing cup 1300 at exit 1350 enters the conduit. FIG. 13 (*a*) is a top view of sealing cup 1300, FIG. (*b*) is a side view of sealing cup 1300. FIG. 13 (*c*) is a section view of sealing cup 1300 and FIG. 13. (*d*) is a bottom view of sealing cup 1300.

Figure 14:
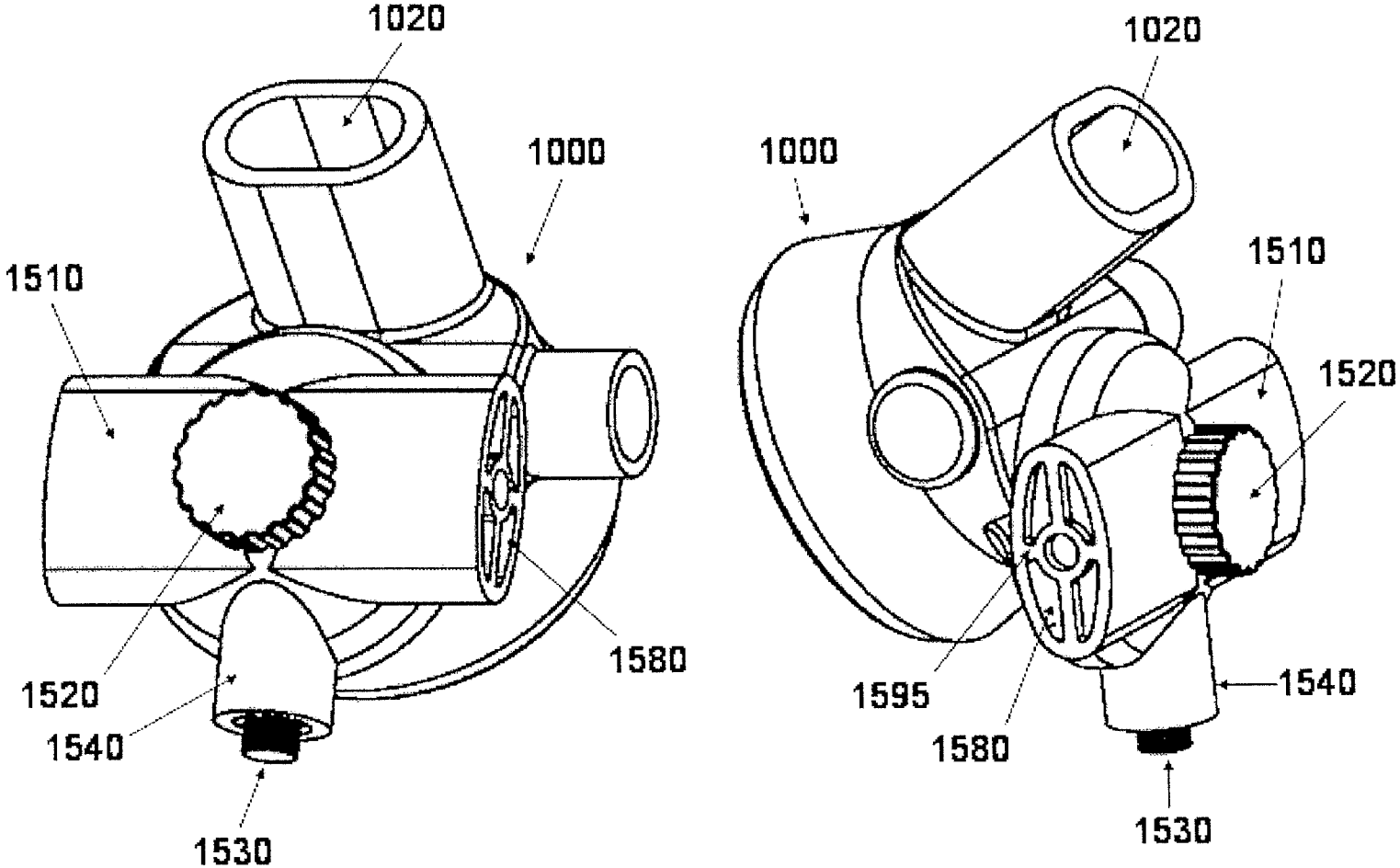
FIG. 14 represents an embodiment of the invention including a second stage regulator and a frequency adjustor.
Figure 15:
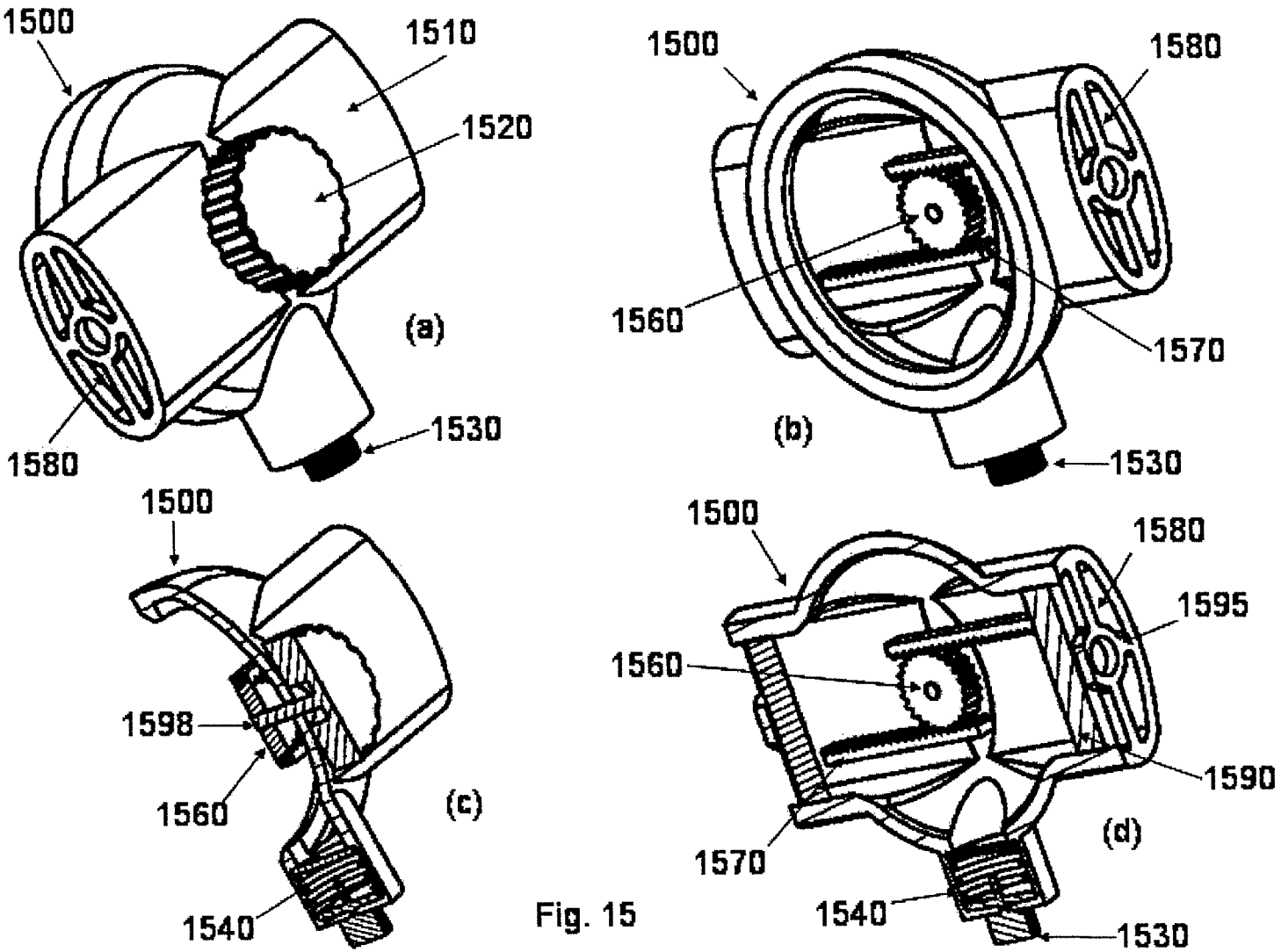
FIG. 15 represents an embodiment of a frequency adjustor having an optional pressure release valve.

FIGS. 14 and 15 show second a stage regulator coupled to a frequency adjustor of the invention and different views of a frequency adjustor of the invention, respectively. With respect to FIGS. 14 and 15, frequency adjustor 1510 is coupled to the conventional second stage regulator in the same manner as sealing cup 1300. As shown in FIGS. 14 (*a*) and (*b*), dial 1520 can be turned to move gates 1590 (shown in FIG. 15) back and forth within the frequency adjustor. When in the "closed" position, gates 1590 seal one or more exit ports 1580 such that exhaled gas is forced to pass through the frequency adjustor 1510. Pressure relief valve 1540 is also shown and optionally includes a pressure adjustment knob 1530. When in the "open" position (for example, any position that is not "closed") the exhaled gas is free to follow the path of least resistance through exit ports 1580.

With respect to FIG. 15, FIG. 15 (*a*) shows a perspective view of an embodiment of the invention. FIG. 15 (*b*) shows a back view of the frequency adjustor of the invention. Dial 1520 engages gear 1560 at connection 1598, as shown in FIG. 15 (*c*). Gear 1560 engages one or more treads 1570, where the tread(s) is directly or indirectly slidingly coupled to the frequency adjustor body or other fixed portion of the device of the present invention, and gates 1590 to thereby move gates 1590 (shown in the cutaway view of FIG. 15 (*d*)). Optional supports 1595 add to the structural integrity of the frequency adjustor. Dial 1520, gear 1560, treads 1570, and gate 1590 can be made from any material, including non-porous polymers such as plastic; ceramic; metal; (e.g., stainless steel or brass) or frequency adjustor material.

In another embodiment, one or more of dial 1520, gear 1560 and treads 1570 are replaced with a switch, such as switch 900, described above.

Kits

In one embodiment, the present invention includes instructions for use for any of the embodiments described herein and/or descriptions of each embodiment.

In one embodiment, a kit of the present invention further includes a conventional regulator having a removable bubble diverter. Such a kit includes one or more of (1) a frequency adjustor that can couple to the second stage in place of the bubble diverter; (2) a sealing cup or sealing switch, conduit, manifold and frequency adjustor; and/or (3) instructions for use and/or assembly.

In one embodiment, a kit of the present invention include a conventional second stage regulator and a frequency adjustor that can retrofit the regulator, e.g., such as the embodiment shown in FIG. 14 or in a "stethoscope" style arrangement or any other arrangement and/or instructions for use and/or assembly.

EXAMPLES

Certain embodiments of the present invention are hereafter described in the following non-limiting examples.

Example 1

A conventional bubble diverter of the second stage of a Mares brand regulator was removed and replaced with a sealing cup of the invention which formed a tight fit around the exhalation port of the second stage. The sealing cup was glued into place with an acrylic glue and sealed using conventional silicone. A plastic tube having an approximate length of about three feet was connected to the sealing cup which in turn was connected to a frequency adjustor manifold. All leaks were sealed with silicone. The plastic tube was then connected to the second stage regulator hose using zip ties. The manifold, having an internal check valve, was then attached to the first stage by using a screw and o-ring to secure the manifold via a low pressure port on the manifold. A frequency adjustor made from Porex, having an average porosity of about 100 microns, a length of about seven inches, a wall thickness of about 0.2 inches and a central bore having a length of about 6.5 inches and a central bore diameter of about 0.8 inches was then screwed into the manifold. The first stage was then coupled to a scuba tank which contained air at a pressure of about 3000 psi.

Example 2

Both sides of a bubble diverter of the second stage of a Mares brand regulator were connected to a frequency adjustor made from Porex, having an average porosity of about 100 microns, a length of about 5.0 inches, a wall thickness of about 0.2 inches and a central bore having a length of about 5.0 inches and a central bore diameter of about 0.8 inches. The connection was made by forming a soft plastic drysuit wrist seal around a side of a bubble diverter and then gluing the other side to the frequency adjustor. The same was performed on the other side of the bubble diverter. Once sealed, exhaled air was forced through the frequency adjustor to check for leaks, which were sealed using conventional silicone. The first stage was then coupled to a scuba tank which contained air at a pressure of about 3000 psi.

Example 3

A videographer and two divers, the first (diver 1) using the regulator system described in Example 1 and the second (diver 2) using the regulator system described in Example 2, entered the water at the Turtle Farm Reef on Grand Cayman. At thirty feet, each diver began to use the frequency adjustors. The frequency adjustor of diver 1 initially failed to function properly and it was discovered that the frequency adjustor was over tightened within the manifold and thereby prevented the check valve from operating properly. At about thirty feet of sea water, the frequency adjustor was loosened slightly and the system began to function normally.

Periodically divers 1 and 2 would switch between conventional regulators and the frequency adjustors. It was observed that approach distances (i.e., the distance a diver can approach a fish before the fish exhibits a startle response and/or swims away) were 40% to 50% shorter when then the frequency adjustor was used. In one instance, diver 2 was able to gently grasp a fish's tail.

As used herein, with respect to a numerical value, the term "about" references + and −10% of the value referenced, inclusive of the value referenced. For example "about 10" means encompasses all values from 9 to 11.

A person of ordinary skill in the art will recognize that the above described embodiments are only exemplary and that many variations could be made without departing from the spirit of the invention. Some features of the embodiments disclosed herein in connection with a particular embodiment useful in other embodiments or may be eliminated without departing from the spirit of the invention. Accordingly, it will be appreciated by persons skilled in the art that numerous variations and/or modifications may be made to the invention shown in the specific embodiments without departing form the spirit and scope of the invention as broadly described. Further, each and every reference cited above is hereby incorporated by reference as if fully set forth herein.

What is claimed is:

1. A composition comprising a frequency adjustor and a switch;

wherein the frequency adjustor comprises a porous body, where the porous body has interstitial spaces and an average porosity between 100 and 500 microns, a proximal end and a distal end, wherein the frequency adjustor alters at least a portion of the frequency of sound produced by exhaled gas from a diving regulator, wherein the frequency of sound produced by the bubbles exiting the frequency adjustor into surrounding fluid through the porous body has a frequency that approximates the background noise of the fluid into which the bubbles are introduced; and, wherein the proximal end is in fluid communication with a second stage scuba regulator; and, wherein the switch has at least an open and a closed position and is coupled to the distal end of the porous body such that when the switch is in the open position a substantial portion of the exhaled gas exits the frequency adjustor at the distal end without going through the porous body, and when the switch is in a closed position a substantial portion of the exhaled gas exits the frequency adjustor by going through the porous body and wherein the exhalation effort that is experienced by a human user during exhalation of the gas through a portion of the porous body is not less than 2.5 inches of water.

2. The composition of claim 1, wherein the frequency of sound produced by exhaled gas from the diving regulator is between 30 to 100 Hz and the frequency of sound produced by at least a portion of the bubbles exiting the frequency adjustor is between 100 Hz and 100,000 Hz.

3. The composition of claim 1, further comprising an adjustable pressure relief valve connected to the frequency adjustor that can be manually set to relieve the internal pressure of the frequency adjustor by releasing exhaled gas directly into the fluid once a user defined pressure is exceeded.

4. A method of altering the noise made by a diver comprising the steps of:

a. directing exhaled gas from a diving regulator into a frequency adjustor wherein the frequency adjustor comprises a porous body, where the porous body has interstitial spaces and an average porosity between 100 and 500 microns, a proximal end and a distal end, wherein the gas passes through the frequency adjustor and escapes into the surrounding fluid;

wherein the proximal end is in fluid communication with a second stage scuba regulator;

b. altering a position of a switch that is coupled to the distal end of the porous body to a closed position, such that when the switch is in a closed position a substantial portion of the exhaled gay exits the frequency adjustor by going through the porous body thereby reducing the bubble size of the bubbles exiting the frequency adjustor into surrounding fluid relative to the size of the bubbles in the absence of the frequency adjustor; and c. thereby increasing the frequency of sound produced by the bubbles exiting the frequency adjustor into surrounding fluid to a frequency that approximates the background noise of the fluid into which the bubbles are introduced; and wherein the exhalation effort that is experienced by a human user during exhalation of the gas through a portion of the porous body is not less than 2.5 inches of water.

5. The method of claim 4, wherein the sound produced by at least a portion of the bubbles exiting the frequency adjustor is increased to greater than 105 Hz.

6. A method of altering the noise made by a diver comprising the steps of:

a. directing exhaled gas from a diving regulator into a frequency adjustor, wherein the gas passes through the frequency adjustor and escapes into the surrounding fluid;

b. reducing the bubble size of the bubbles exiting the frequency adjustor into surrounding fluid relative to the size of the bubbles in the absence of the frequency adjustor;

c. increasing the frequency of sound produced by the bubbles exiting the frequency adjustor into surrounding fluid to a frequency that approximates the background noise of the fluid into which the bubbles are introduced;

wherein the frequency adjustor comprises a porous body where the porous body has interstitial spaces and an average porosity between 100 and 500 microns a proximal end, a distal end a switch coupled to the distal end and a void volume of greater than 20%, wherein less than 80% of the void volume of the frequency adjustor is filled with water in 1 to 3 seconds during a diver inhalation; wherein the frequency adjustor is in fluid communication with the diver's lungs such that at least a portion of the diver's exhaled gas is urged to enter the frequency adjustor by diver exhalation pressure; wherein the switch has at least an open and a closed position such that when the switch is in the open position a substantial portion of the exhaled gas exits the frequency adjustor at the distal end without going through the porous body, and when the switch is in a closed position a substantial portion of the exhaled gas exits the frequency adjustor by going through the porous body; and, wherein at least 50% of the volume of gas exhaled by the diver exits the frequency adjustor and enters the water in under 2 to 5 seconds after exhalation; and wherein the frequency adjustor alters the frequency of sound produced by exhaled gas by increasing the frequency of sound produced by at least a portion of the bubbles to above 105 Hz; and wherein the exhalation effort that is experienced by a human user during exhalation of the gas through a portion of the porous body is not less than 2.5 inches of water.

7. The method of claim 6, wherein the amount of sound produced by the bubbles between 10 and 100 Hz is reduced.

8. The method of claim 6, wherein the exhalation effort of the diver is less than 15 inches of water.

9. The method of claim 7, wherein the exhalation effort of the diver is less than 15 inches of water.

10. The method of claim 6, wherein the exhalation effort of the diver is less than 10 inches of water.

11. The method of claim 6, wherein the exhalation effort of the diver is less than 5.5 inches of water.

12. The composition of claim 1, wherein the background noise of the fluid into which the bubbles are introduced has frequencies of about 100 Hz to 100,000 Hz.

13. A method of altering the exhalation of a human user comprising:

providing a tubular porous body to a human, wherein the tubular porous body has a wall defining a gas flow passageway through at least a portion of the tubular porous body, wherein at least a portion of the wall has interstitial spaces and an average porosity between 30 and 100 microns or 100 and 500 microns, and wherein the tubular porous body has an open proximal end in fluid communication with the gas flow passageway; and wherein the tubular porous body is configured to be placed in fluid communication with a human user such that a substantial portion of the human exhaled gas enters the tubular porous body at the open proximal end and exits the porous body by first flowing through the gas flow passageway and then through the wall portion before entering a surrounding environment, wherein the exhalation effort that is experienced by the human user during exhalation of the gas through the wall portion of the tubular porous body is not less than 2.5 inches of water.

14. The method of claim 13, wherein the surrounding environment is not a water environment.

15. The method of claim 13, wherein the surrounding environment is a water environment, and when the exhaled gas exits the porous body and enters the water, the exhaled gas creates a bubble noise having a frequency that is greater than 105 Hz.

* * * * *